US007266326B2

(12) United States Patent
Karakama et al.

(10) Patent No.: US 7,266,326 B2
(45) Date of Patent: Sep. 4, 2007

(54) PROCESS CARTRIDGE REMANUFACTURING METHOD

(75) Inventors: Toshiyuki Karakama, Susono (JP); Noriyuki Komatsu, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 11/105,553

(22) Filed: Apr. 14, 2005

(65) Prior Publication Data

US 2005/0232654 A1 Oct. 20, 2005

(30) Foreign Application Priority Data

Apr. 16, 2004 (JP) ..... 2004-121927
Apr. 8, 2005 (JP) ..... 2005-112646

(51) Int. Cl.
*G03G 15/00* (2006.01)

(52) U.S. Cl. ..... 399/109

(58) Field of Classification Search ..... 399/109, 399/111, 113
See application file for complete search history.

(56) References Cited

U.S. PATENT DOCUMENTS

| | | | | |
|---|---|---|---|---|
| 5,500,714 | A | 3/1996 | Yashiro et al. | |
| 5,543,898 | A | 8/1996 | Shishido et al. | |
| 5,585,895 | A | 12/1996 | Yashiro et al. | |
| 5,617,579 | A | 4/1997 | Yashiro et al. | 399/114 |
| 5,749,027 | A | 5/1998 | Ikemoto et al. | 399/113 |
| 5,774,766 | A | 6/1998 | Karakama et al. | 399/111 |
| 5,878,310 | A | 3/1999 | Noda et al. | 399/117 |
| 5,890,036 | A | 3/1999 | Karakama et al. | 399/119 |
| 5,899,602 | A | 5/1999 | Noda et al. | 399/111 |
| 5,966,566 | A | 10/1999 | Odagawa et al. | 399/109 |
| 6,795,666 | B2 * | 9/2004 | Miyabe et al. | 399/109 |
| 6,856,775 | B2 * | 2/2005 | Sekine | 399/109 |
| 6,931,226 | B2 * | 8/2005 | Chadani et al. | 399/109 |
| 6,941,092 | B2 * | 9/2005 | Yokoi | 399/109 |
| 6,952,544 | B2 * | 10/2005 | Kikuchi et al. | 399/109 |
| 6,970,668 | B2 * | 11/2005 | Ueno et al. | 399/109 |
| 7,024,131 | B2 * | 4/2006 | Komatsu et al. | 399/109 |
| 7,062,199 | B1 * | 6/2006 | Higeta et al. | 399/109 |
| 7,162,181 | B2 * | 1/2007 | Maeshima et al. | 399/109 |
| 2002/0159788 | A1 | 10/2002 | Miyabe et al. | 399/109 |
| 2004/0045156 | A1 | 3/2004 | Kikuchi et al. | 29/700 |
| 2004/0134070 | A1 | 7/2004 | Komatsu et al. | 29/895.2 |
| 2004/0136746 | A1 | 7/2004 | Komatsu et al. | 399/104 |

* cited by examiner

*Primary Examiner*—William J. Royer
(74) *Attorney, Agent, or Firm*—Fitzpatrick, Cella, Harper & Scinto

(57) ABSTRACT

A process cartridge remanufacturing method including: detaching first and second covers, at one and the other longitudinal ends of a process cartridge, from drum and developing frames; detaching a drum supporting member from the drum frame; separating the developing and drum frames; detaching a developing roller from the developing frame; filling a developer containing portion with the developer from a developer supply port provided on the developing frame; mounting a developing roller to a developing frame; mounting a photosensitive drum to a drum frame; securing the drum frame and the developing frame by a first cover; securing the drum and developing frames by a second cover; temporarily mounting a drum supporting member to support the photosensitive; and mounting the drum supporting member and the second cover to the drum frame by mounting a fixation member to a mounting hole provided in the second cover by using the screw.

9 Claims, 42 Drawing Sheets

PROCESS CARTRIDGE REMANUFACTURING METHOD

BACKGROUND OF THE INVENTION

1. Field of the Invention

The present invention relates to a method of remanufacturing a process cartridge detachably mountable to a main body of an electrophotographic image forming apparatus.

2. Related Background Art

Conventionally, in an image forming apparatus using the electrophotographic image forming process, there is adopted a process cartridge system in which an electrophotographic photosensitive drum and process means acting on the electrophotographic photosensitive drum are integrated into a cartridge, which is detachably mountable to the main body of the electrophotographic image forming apparatus.

In the process cartridge system, the user himself can perform apparatus maintenance without relying on a serviceman, thereby achieving a marked improvement in terms of operability.

In the process cartridge system, an image is formed on a recording medium by using developer. Thus, as image formation is repeated, the developer is gradually consumed. When the developer has been consumed to a degree that image formation is no longer possible, the process cartridge is of no commercial value.

In order to remanufacture a process cartridge with frame connecting portions where resin bonding is effected, there has been proposed a technique according to which after the resin-bonded portions are cut, the frames are re-connected, with a spacer being held between the bonded portions (see US-2002-0159788).

SUMMARY OF THE INVENTION

The present invention aims to further improve the above conventional technique.

It is an object of the present invention to provide a simple process cartridge remanufacturing method.

Another object of the present invention is to provide a process cartridge remanufacturing method which makes it possible to prepare for the market again a process cartridge the developer of which has been consumed to a degree that an image of a quality satisfying the user cannot be formed any more, making the process cartridge of no commercial value.

Still another object of the present invention is to provide a process cartridge remanufacturing method for a process cartridge detachably mountable to an electrophotographic image forming apparatus and including: an electrophotographic photosensitive drum; a drum frame supporting the electrophotographic photosensitive drum; a developing roller adapted to develop an electrostatic latent image formed on the electrophotographic photosensitive drum by using a developer; a developing frame supporting the developing roller and having a developer containing portion containing the developer; a first cover member for securing the developing frame and the drum frame in position at one longitudinal end of the drum frame; a second cover member for securing the developing frame and the drum frame in position at the other longitudinal end of the drum frame; and a drum supporting member which serves to support the electrophotographic photosensitive drum on the drum frame and which is fixed by a screw to a screw hole provided at the other longitudinal end of the drum frame, the drum frame and the developing frame being connected to the second cover member by pouring molten resin into resin bonding portions provided in the drum frame, the developing frame, and the second cover member, the process cartridge remanufacturing method including: (a) a first cover detaching step of detaching, at one longitudinal end of the process cartridge, the first cover member from the drum frame and the developing frame; (b) a second cover detaching step of detaching, at the other longitudinal end of the process cartridge, the second cover member from the drum frame and the developing frame; (c) a drum supporting member detaching step of detaching the drum supporting member from the drum frame; (d) a frame separating step of separating the developing frame and the drum frame; (e) a developing roller detaching step of detaching the developing roller from the developing frame; (f) a developer re-filling step of filling the developer containing portion with the developer from a developer supply port provided on the developing frame exposed by detaching the developing roller from the developing frame; (g) a developing roller fixation step of mounting a developing roller to a developing frame; (h) a drum mounting step of mounting, at the one longitudinal end, an electrophotographic photosensitive drum to a drum frame; (i) a first frame connecting step of securing the drum frame and the developing frame in position at the one longitudinal end by a first cover member; (j) a second frame connecting step of securing the drum frame and the developing frame in position at the other longitudinal end by a second cover member; (k) a drum supporting member temporary mounting step of temporarily mounting a drum supporting member to support the electrophotographic photosensitive drum at the other longitudinal end of the drum frame; and (l) a second cover member mounting step of mounting the drum supporting member and the second cover member to the drum frame by mounting a fixation member to a mounting hole provided in the second cover member by using the screw.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

In the following, examples of the best mode for carrying out the present invention will be described in detail with reference to the drawings and embodiments. The functions, materials, configurations, and positional relationships of the components as described in the following embodiments should not be construed restrictively unless otherwise specified. Further, the materials, configurations, and the like of the components described below are common to the embodiments unless otherwise noted.

Embodiment 1

In the following, a process cartridge to which a process cartridge remanufacturing method of the present invention is suitably applicable, and an electrophotographic image forming apparatus to which the process cartridge is detachably mountable, will be described with reference to the drawings.

Here, the electrophotographic image forming apparatus is an apparatus which forms an image on a recording medium by using an electrophotographic image forming system. Examples of the electrophotographic image forming apparatus include an electrophotographic copying machine, an electrophotographic printer (a laser printer, an LED printer, or the like), a facsimile apparatus, and a word processor.

The process cartridge is obtained by integrating a charging means, a developing means or a cleaning means, and an electrophotographic photosensitive member into a cartridge, which is detachably mountable to the main body of the electrophotographic image forming apparatus.

Alternatively, at least one of a charging means, a developing means, and a cleaning means and an electrophotographic photosensitive member are integrated into a cartridge, which is detachably mountable to the main body of the electrophotographic image forming apparatus.

In the following description, the transverse direction of the process cartridge is the direction in which the process cartridge is attached to and detached from the main body of the electrophotographic image forming apparatus, and coincides with the direction in which the recording medium is conveyed. The longitudinal direction of the process cartridge is a direction crossing (substantially perpendicular to) the direction in which the process cartridge is attached to and detached from the main body of the electrophotographic image forming apparatus; it is a direction parallel to the surface of the recording medium and crossing the direction in which the recording medium is conveyed.

(General Construction of the Electrophotographic Image Forming Apparatus)

Figure 1:
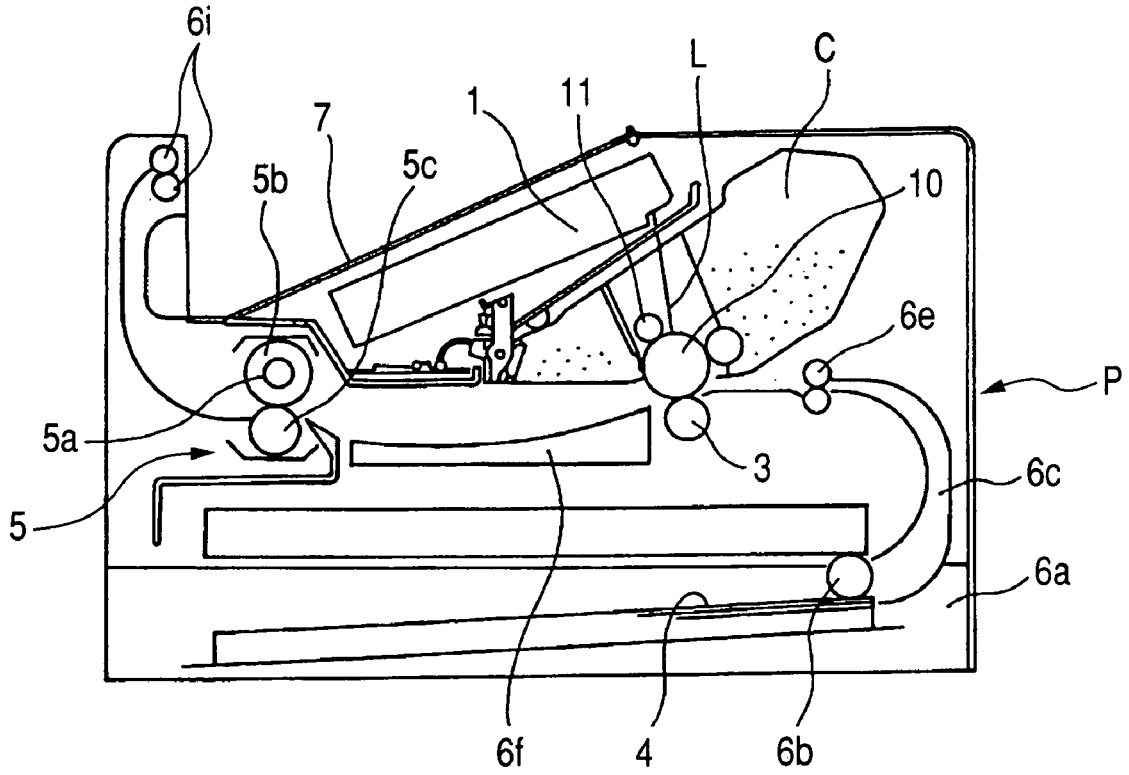
FIG. 1 is a sectional view of an electrophotographic image forming apparatus according to an embodiment of the present invention.

Referring to FIG. 1, a laser beam printer constituting an example of the electrophotographic image forming apparatus (hereinafter referred to as the "image forming apparatus") will be described. An image forming apparatus main body P, shown in FIG. 1, forms an image on a recording medium 4 (e.g., a recording paper sheet, OHP sheet, or cloth) by an electrophotographic image forming process.

The surface of a photosensitive drum 10, which is a drum-shaped electrophotographic photosensitive member, is uniformly charged by a charging roller 11. A laser beam L corresponding to image information is applied to the charged photosensitive drum 10 from an optical means 1, and a latent image corresponding to the image information is formed on the photosensitive drum 10. The latent image formed on the photosensitive drum 10 is developed by a developing means described below, with the result that a toner image is formed on the photosensitive drum 10.

The recording medium 4, contained in a sheet feeding cassette 6*a*, is conveyed by a pickup roller 6*b*, a conveying guide 6*c*, and a registration roller pair 6*e* in synchronism with the formation of the toner image. Then, the recording medium 4 passes a nipping portion formed by a transfer roller 3, to which a fixed voltage is applied, and the photosensitive drum 10. At this time, the toner image on the photosensitive drum 10 is transferred to the recording medium 4. The recording medium 4 to which the toner image has been transferred passes a conveying guide 6*f* and is conveyed to a fixing means 5.

The fixing means 5 has a driving roller 5*c* and a fixing roller 5*b* containing a heater 5*a*. By applying heat and pressure to the recording medium 4 passing the nipping portion of the driving roller 5*c* and the fixing roller 5*b*, the transferred toner image is fixed to the recording medium 4. Thereafter, the recording medium 4 is conveyed by a discharging roller pair 6*i* to be discharged onto a discharge tray 7.

(Process Cartridge)

Next, a process cartridge C will be described with reference to FIG. 2.

Figure 2:
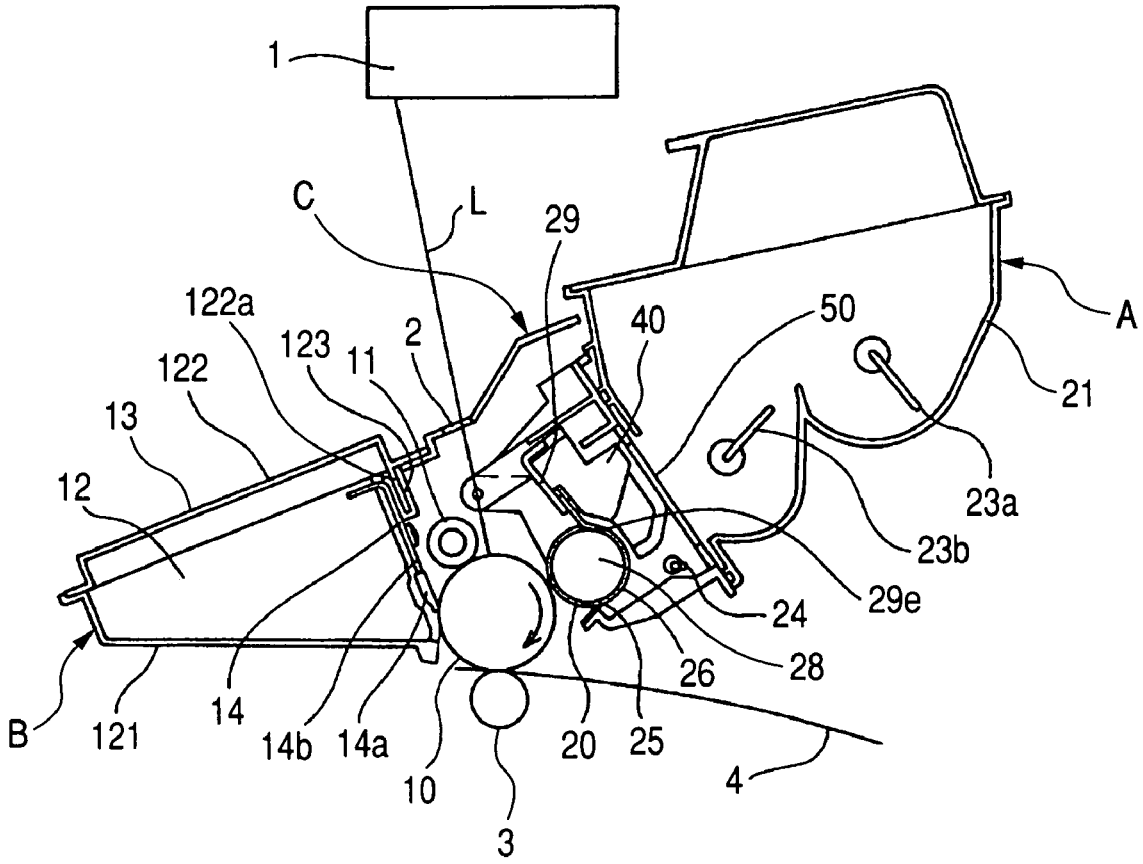
FIG. 2 is a sectional view of a process cartridge according to an embodiment of the present invention.

As shown in FIG. 2, the process cartridge C is obtained by connecting a developing apparatus unit A and a photosensitive member unit B with each other.

The developing apparatus unit A has a developer frame 21 containing toner, a developing roller 20 which supplies toner to an electrostatic latent image formed on the photosensitive drum 10 to thereby form a visible image, a developing blade 29 which imparts triboelectrification charge to the toner to form a toner layer on the surface of the developing roller 20, and the like.

Further, at a lower opening between the developing roller 20 and a developing roller frame 50, there is provided a spouting prevention sheet 25 for preventing toner on a lower portion of the developing roller 20 from leaking.

The above-mentioned developing means sends out the toner in the developer frame 21 to the developing roller 20 through rotation of toner carrying members 23*a* and 23*b*. Then, the developing roller 20, which contains a stationary magnet 28, is rotated, and the thickness of the toner layer on the developing roller 20 is regulated by a blade 29*e* integrally formed with or glued to the developing blade 29. In the process, triboelectrification charge is imparted to the toner.

The developing roller 20 is pressed against the photosensitive drum 10 by an urging spring 32 (see FIG. 7) while maintaining a fixed clearance between itself and the photosensitive drum 10 through the intermediation of a spacer runner 26. The toner on the surface of the developing roller 20 is supplied to the photosensitive drum 10.

The supplied toner is transferred to the photosensitive drum 10 in correspondence with the electrostatic latent image, whereby a toner image is formed. Further, in the vicinity of the developing roller 20, there is rotatably mounted a toner agitating member 24 for circulating the toner in the developing chamber.

The photosensitive member unit B has the photosensitive drum 10 for forming an electrostatic latent image, the charging roller 11 for uniformly charging the surface of the photosensitive drum 10, a cleaning blade 14 for scraping off, from the surface of the photosensitive drum 10, residual toner adhering to the photosensitive drum 10 without being transferred to the recording medium 4, a waste toner container 12 for storing the toner scraped off, and the like.

In FIG. 2, the photosensitive drum 10 rotates clockwise.

The charging roller 11, to which a fixed voltage is applied, comes into contact with the photosensitive drum 10, thereby uniformly charging the surface of the photosensitive layer of the photosensitive drum 10.

Next, the laser beam L corresponding to image information from the optical means 1 is applied to the surface of the photosensitive drum 10 through an exposure opening 2, and an electrostatic latent image is formed on the photosensitive drum 10. Thereafter, a toner image is formed on the photosensitive drum 10 by the developing means.

The transfer roller 3 is provided in the main body P of the image forming apparatus, and undergoes application of a voltage of a polarity reverse to that of the toner image. After the toner image formed on the photosensitive drum 10 is transferred to the recording medium 4, the residual toner on the photosensitive drum 10 is removed by the cleaning blade 14. Here, the cleaning blade 14 scrapes off the residual toner remaining on the photosensitive drum 10 by a blade 14*a* held in contact with the photosensitive drum 10, and collects the toner in the waste toner container 12.

(Housing Construction of the Process Cartridge C)

Next, the housing construction of the process cartridge C of this embodiment will be described.

The process cartridge C of this embodiment is obtained by connecting together into a cartridge the developing apparatus unit A, which is formed by connecting together the developer frame 21 and the developing roller frame 50 and to which a support frame 40 as the developing frame holding the developing blade 29 is connected, and the photosensitive member unit B, which has a drum frame 13 accommodating the photosensitive drum 10, the charging roller 11, the cleaning blade 14, and the like.

Further, the process cartridge C can be detachably attached to a cartridge attachment means provided in the main body P of the image forming apparatus.

(Developing Apparatus Unit A)

As shown in FIG. 2, the developing apparatus unit A is composed of the developer frame 21 and the developing roller frame 50 constituting the developing frame.

Figure 3:
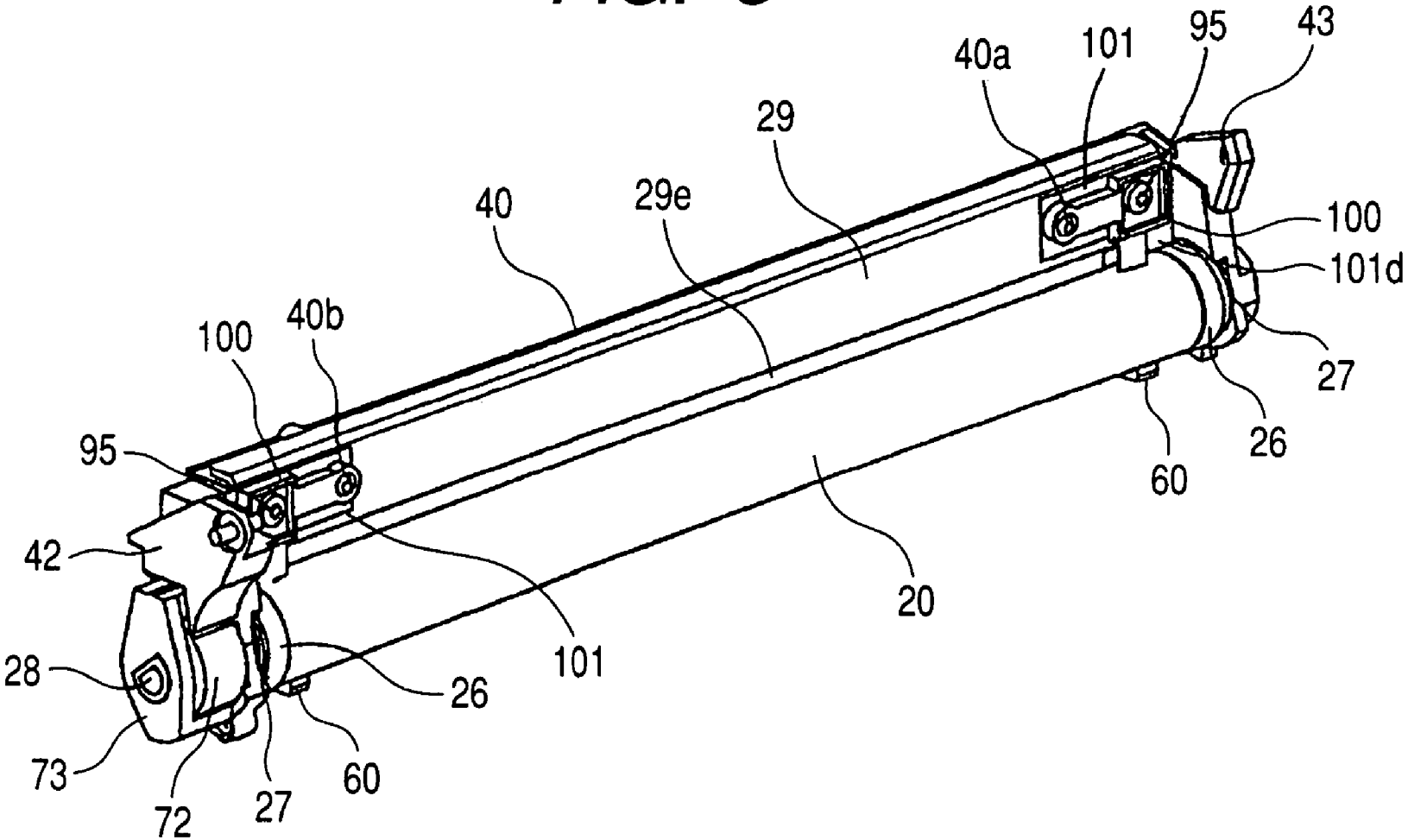
FIG. 3 is a perspective view of a support frame according to the embodiment of the present invention and portions in the vicinity thereof.
Figure 4:
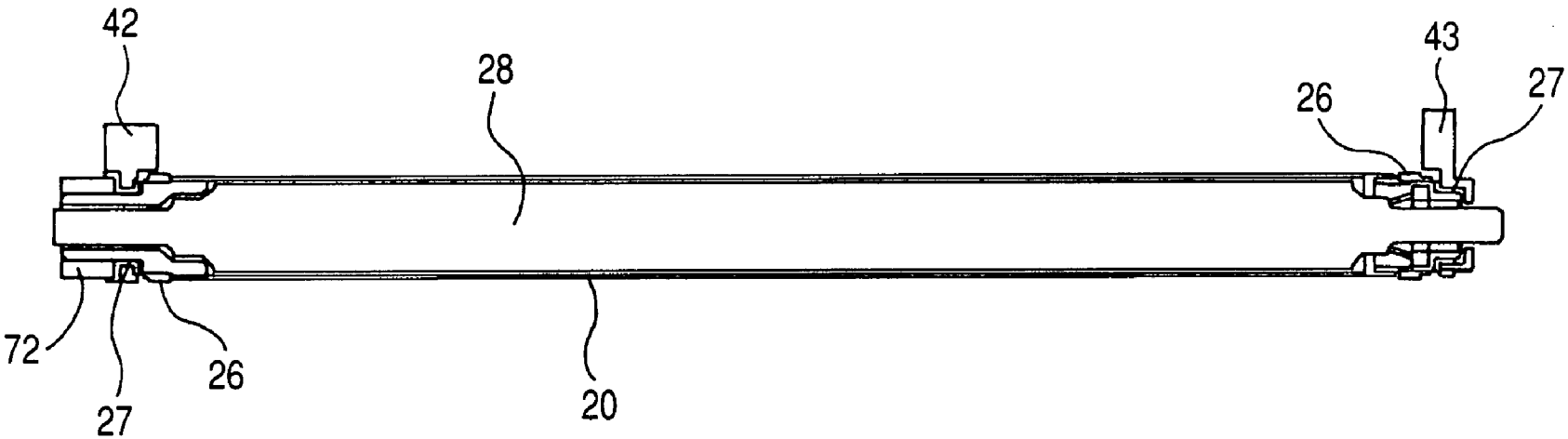
FIG. 4 is a sectional view of a developing roller according to the embodiment of the present invention and portions in the vicinity thereof.

As shown in FIGS. 3 and 4, at the ends of the support frame 40, there are arranged a first end cover 42 and a second end cover 43. The support frame 40, the first end cover 42, and the second end cover 43 are secured to each other, and in this state, hold the developing roller 20 and the developing blade 29.

The developing roller 20 is rotatably supported at both ends by the first end cover 42 and the second end cover 43 through the intermediation of bearings 27.

Further, rotatably provided at both ends of the developing roller 20 are spacer runners 26 substantially coaxial with the developing roller 20 and having an outer diameter larger than the outer diameter of the developing roller 20 by a dimension corresponding to the requisite gap between the photosensitive drum 10 and the developing roller 20.

The developing blade 29 is fit-engaged with positioning bosses 40*a* and 40*b* of the support frame 40 for positioning, and is secured in position by screws 95. The distal end of the blade 29*e* is in contact with the developing roller 20.

At one end of the developing roller 20, there are provided a developing roller gear 72 for transmitting torque to the developing roller 20, a detachment preventing member for the developing roller gear 72, and a stationary member 73 for determining the phase of the stationary magnet 28 contained in the developing roller 20.

Further, at the longitudinal ends of the developing blade 29, there are provided toner regulating members 100 that scrape off the toner at the end portions of the developing roller 20 to move it longitudinally inwards.

Further, between the developing blade 29 and the toner regulating members 100, there are provided thin-plate-like scrapers 101. The distal ends 101*d* of the scrapers 101 are in contact with the spacer runners 26. The scrapers 101 scrape off dirt, such as toner, adhering to the spacer runners 26, thus preventing a fluctuation in the distance between the photosensitive drum 10 and the developing roller 20. Further, at the longitudinal ends of the developing roller 20, there are arranged magnetic seals 60.

Figure 5:
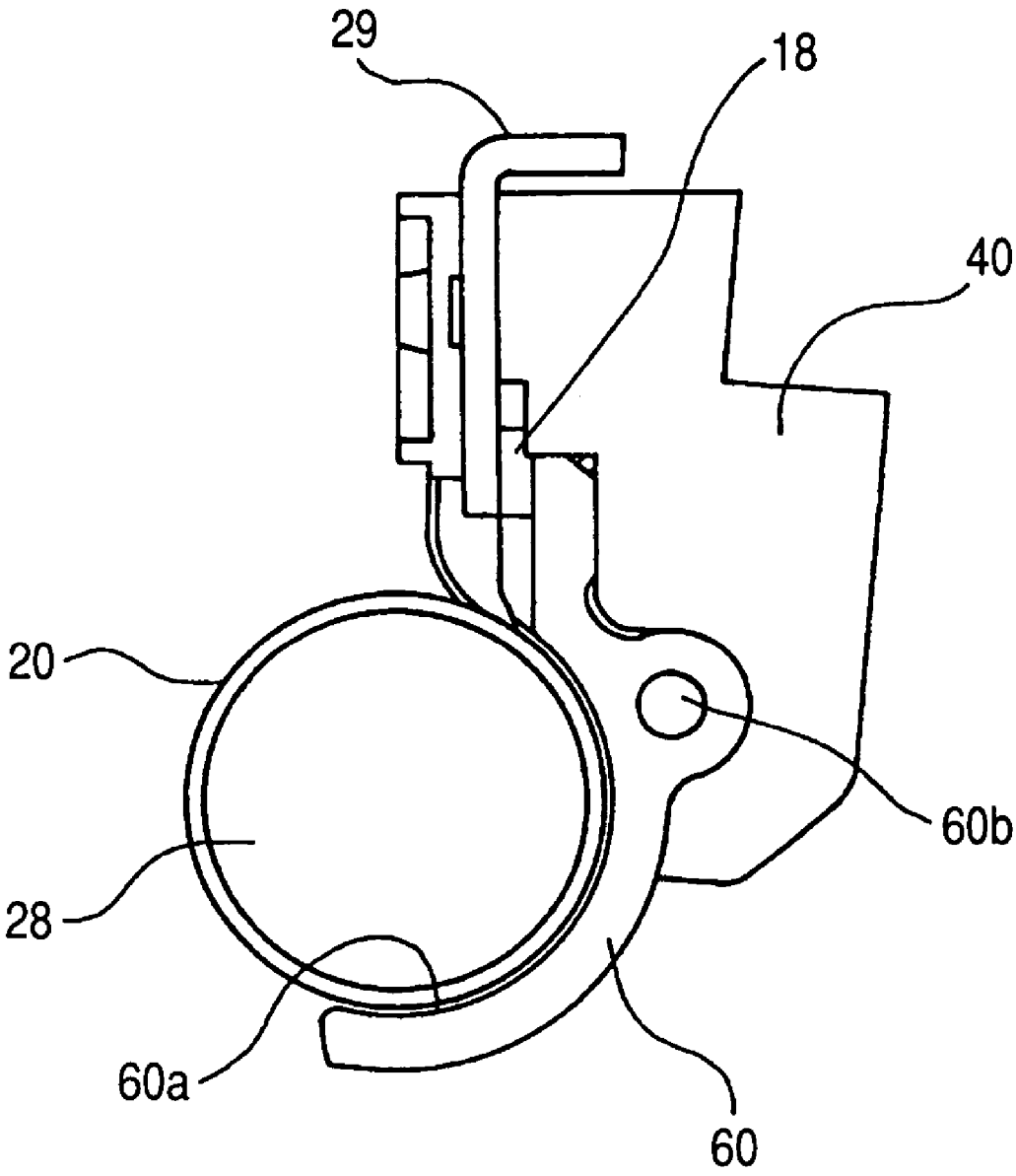
FIG. 5 is a sectional view of a magnetic seal portion and portions in the vicinity thereof.

As shown in FIG. 5, each magnetic seal 60 has a plurality of magnetic poles on the surface 60*a* opposed to the surface of the developing roller 20, and serves as a seal means that attracts toner by a magnetic circuit formed between it and the stationary magnet 28 in the developing roller 20. The developing roller 20 and the magnetic seals 60 are fixed to the same support frame 40, so that even when the developing roller 20 is driven by the outer periphery of the photosensitive drum 10 to move the support frame 40, it is possible to set the clearance between the developing roller 20 and the magnetic seals 60 to a fixed dimension. Thus, it is possible to effect toner sealing in a satisfactory manner at both ends of the developing roller 20 by the magnetic seals 60.

Figure 6B:
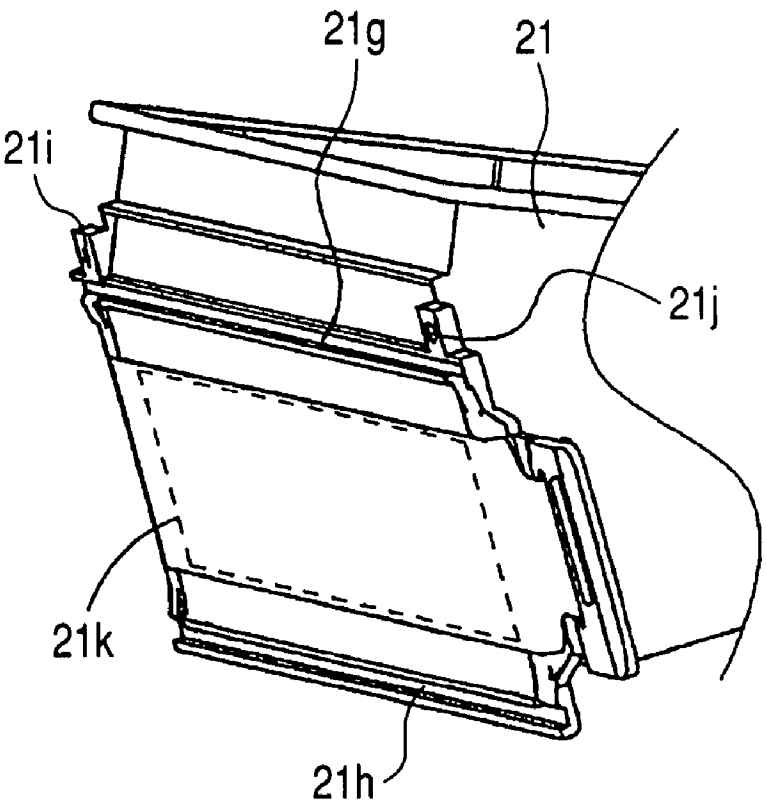
FIGS. 6A and 6B are perspective views illustrating a fusion-bonding portion of a developing frame and a developer frame.
Figure 6A:
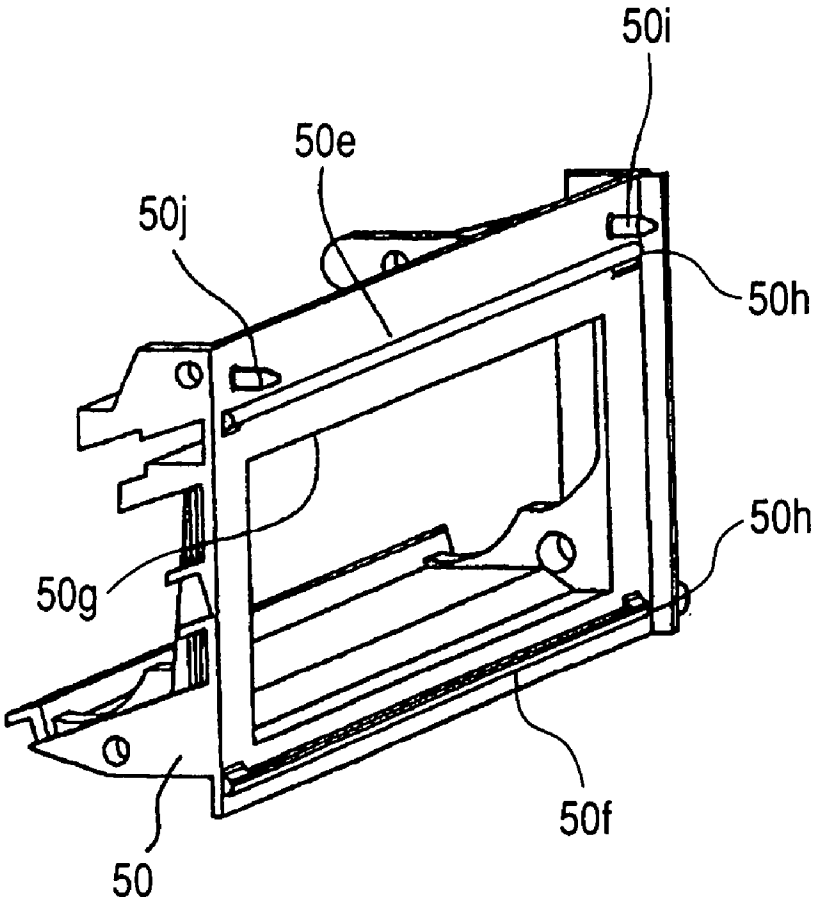

As shown in FIGS. 6A and 6B, the developing roller frame 50 and the developer frame 21 are fixed to each other through fusion bonding (described below) of fusion-bonding ribs 50*e* and 50*f* provided on the upper and lower sides of an opening 50*g* of the developing roller frame 50 and fusion-bonding planes 21*g* and 21*h* provided on the upper and lower sides of an opening 21*k* of the developer frame 21.

Figure 7:
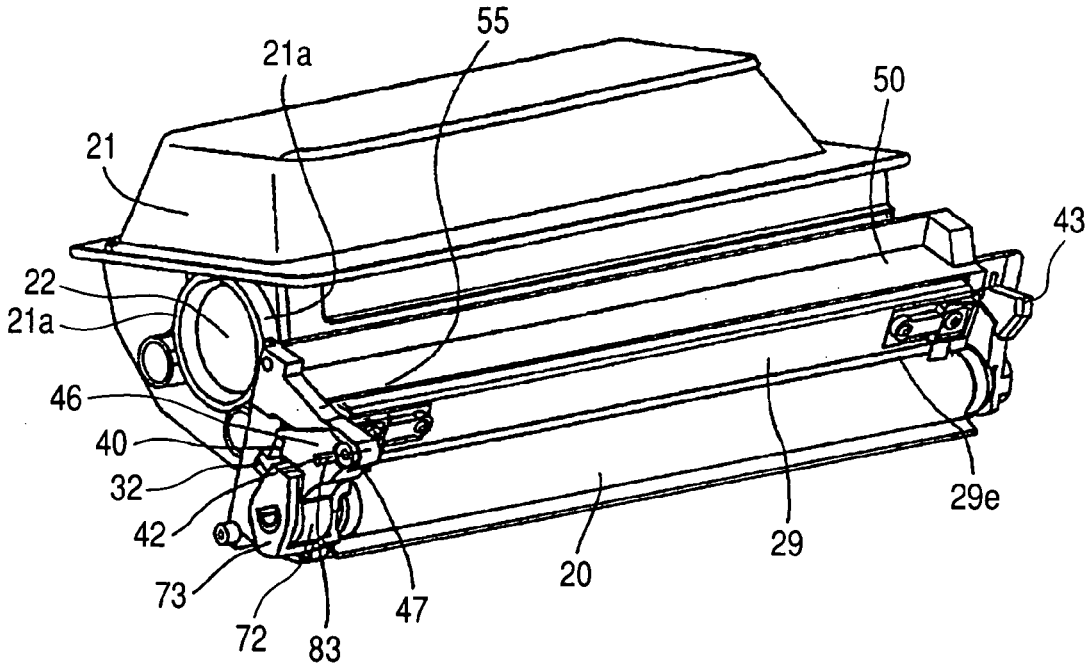
FIG. 7 is a perspective view of a developing apparatus unit according to the embodiment of the present invention.

As shown in FIG. 7, a toner filling port 21*a* is provided in a side surface of the developer frame 21. After filling the developer frame 21 with toner through the toner filling port 21*a*, the toner filling port 21*a* is stopped by a toner cap 22 to effect tight closing to thereby prevent leakage of toner.

The support frame 40 is installed in the developing roller frame 50. The first end cover 42 fixed to the support frame 40 is equipped with a rocking arm 46 having a rocking hole 47 at an end thereof. The developing roller frame 50 is equipped with a support arm 55 having a fixation hole 56 (see FIG. 19) at an end thereof. The first end cover 42 and the developing roller frame 50 are rotatably connected by a fixation pin 83.

Clearance fit allowing rotation is effected between the rocking hole 47 of the first end cover 42 and the fixation pin 83, and close fit is effected between the fixation hole 56 of the developing roller frame 50 and the fixation pin 83.

Figure 8:
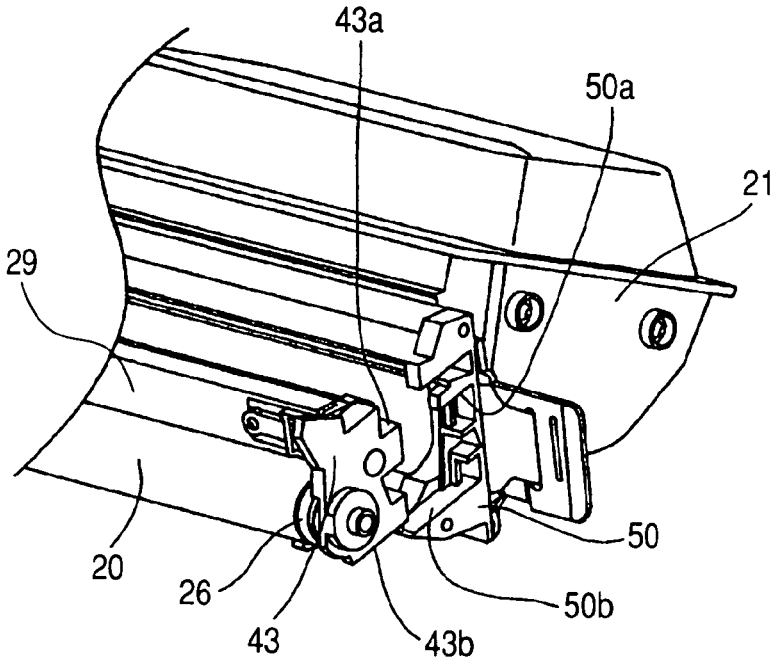
FIG. 8 is a partial perspective view of the developing apparatus unit according to the embodiment of the present invention.

As shown in FIG. 8, slide planes 43*a* and 43*b* determining the sliding direction are provided parallel to each other substantially on the upper and lower surface of the second end cover 43. On the portions of the developing roller frame 50 opposed to the slide planes 43*a* and 43*b*, there are provided guide planes 50*a* and 50*b*, with minute clearances therebetween. Due to the slide planes 43*a* and 43*b* and the guide planes 50*a* and 50*b*, the second end cover 43 can slide in a fixed direction.

As shown in FIG. 7, an urging spring 32 is provided between the first end cover 42 and the developing roller frame 50. Similarly, an urging spring 32 (not shown) is also provided between the second end cover 43 and the developing roller frame 50. The urging springs 32 press the developing roller 20 provided on the support frame 40 against the photosensitive drum 10, with a fixed clearance due to the spacer runners 26 therebetween.

(Photosensitive Member Unit B)

The construction of the photosensitive member unit B will be described with reference to FIGS. 9, 10, and 11. A driving side flange 10*a* is mounted to one end of the photosensitive drum 10, and a non-driving side flange 10*b* is mounted to the other end of the photosensitive drum 10. The driving side flange 10*a* has a coupling protrusion 10*a*1, a shaft portion 10*a*2, and a gear portion 10*a*3 for driving a developing roller gear (not shown). The non-driving side flange 10*b* has an inner peripheral portion 10*b* 1 for insertion of a centering shaft 31, and a gear portion 10*b*2 for driving a transfer roller gear (not shown) of the main body P of the image forming apparatus.

The photosensitive drum 10 is supported as follows: on the right-hand (drive input) side, the drum bearing 30 is fixed to the side portion 13*a* of the drum frame 13 by means of a screw 99, with the inner peripheral portion 30*a* of the drum bearing 30 and the shaft portion 10*a*2 of the driving side flange 10*a* being rotatably fit-engaged with each other.

In the drum bearing 30, an outer diameter portion 30*c* coaxial with the inner peripheral portion 30*a* protrudes longitudinally inwards. The outer diameter portion 30*c* is fit-engaged with an arcuate cutout portion 13*o* provided in the drum frame 13. The width of the opening of the cutout portion 13*o* is larger than the diameter of the shaft portion 10*a*2.

The coupling protrusion 10*a*1 of the driving side flange 10*a* is formed as a twisted prism.

Figure 12:
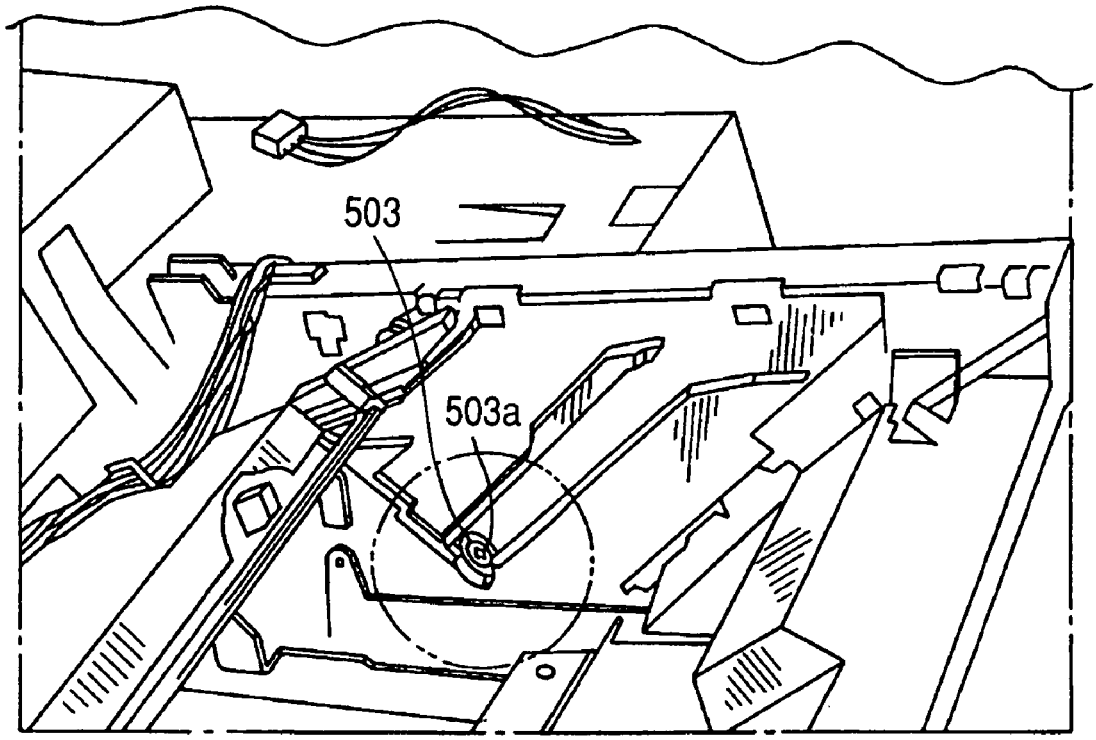
FIG. 12 is a perspective view of a drive transmission member of an electrophotographic image forming apparatus and portions in the vicinity thereof.

As shown in FIG. 12, when the process cartridge C is attached to the main body P of the image forming apparatus, the coupling protrusion 10*a*1 is fit-engaged with a drive transmission member 503 having a twisted polygonal hole 503*a* provided in the main body P of the image forming apparatus and receives the torque. At the same time, the driving side flange 10*a* is pulled toward the drive transmission member 503 for alignment.

Figure 9:
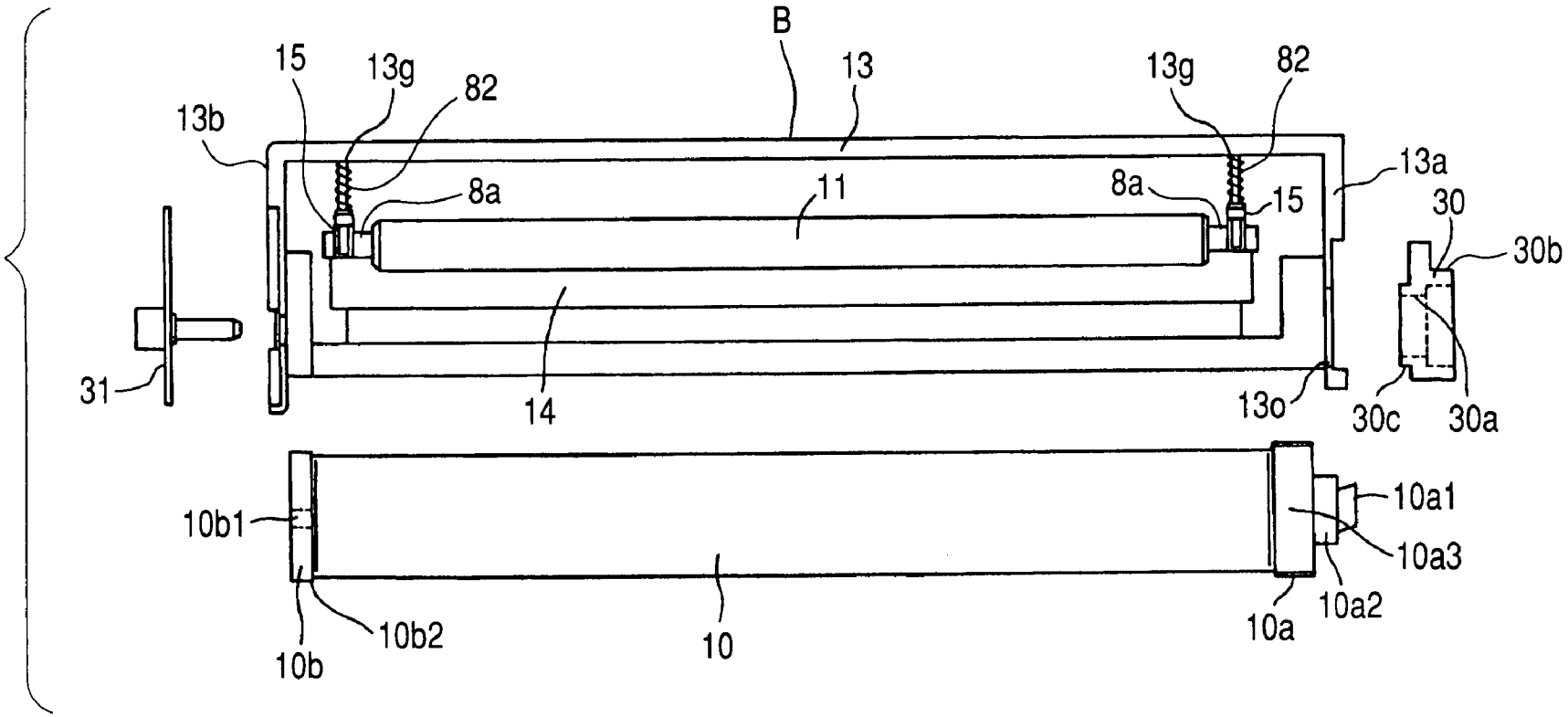
FIG. 9 is an exploded top view of a photosensitive member unit according to the embodiment of the present invention.
Figure 10:
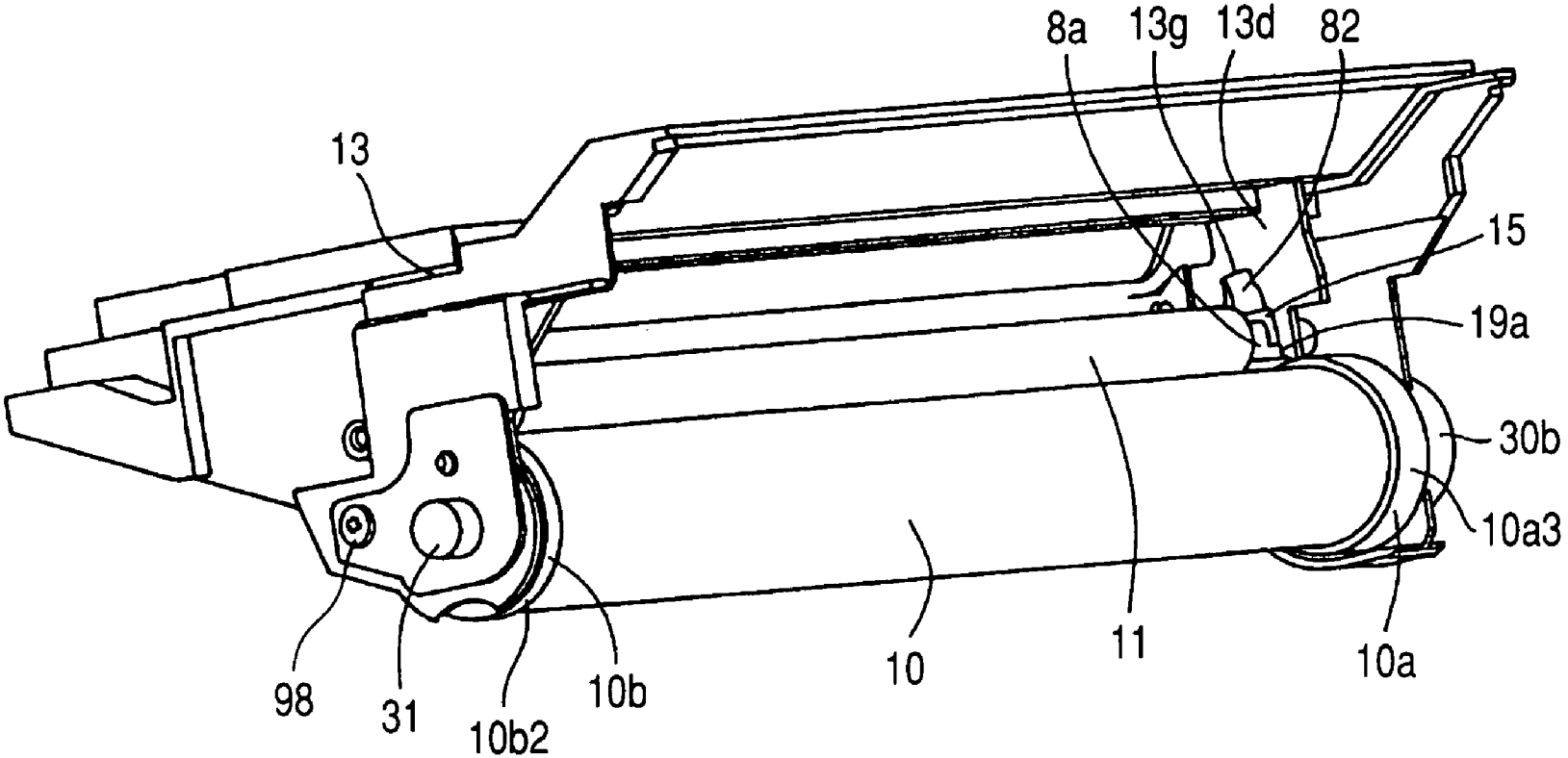
FIG. 10 is a perspective view of the photosensitive member unit according to the embodiment of the present invention.

Further, as shown in FIGS. 9 and 10, on the left-hand (non-drive-input) side, the centering shaft 31 is fixed to the side portion 13*b* of the drum frame 13 by means of a screw 98, with the centering shaft 31 being rotatably fit-engaged with the inner peripheral portion 10*b* 1 of the non-driving side flange 10*b*.

Figure 11:
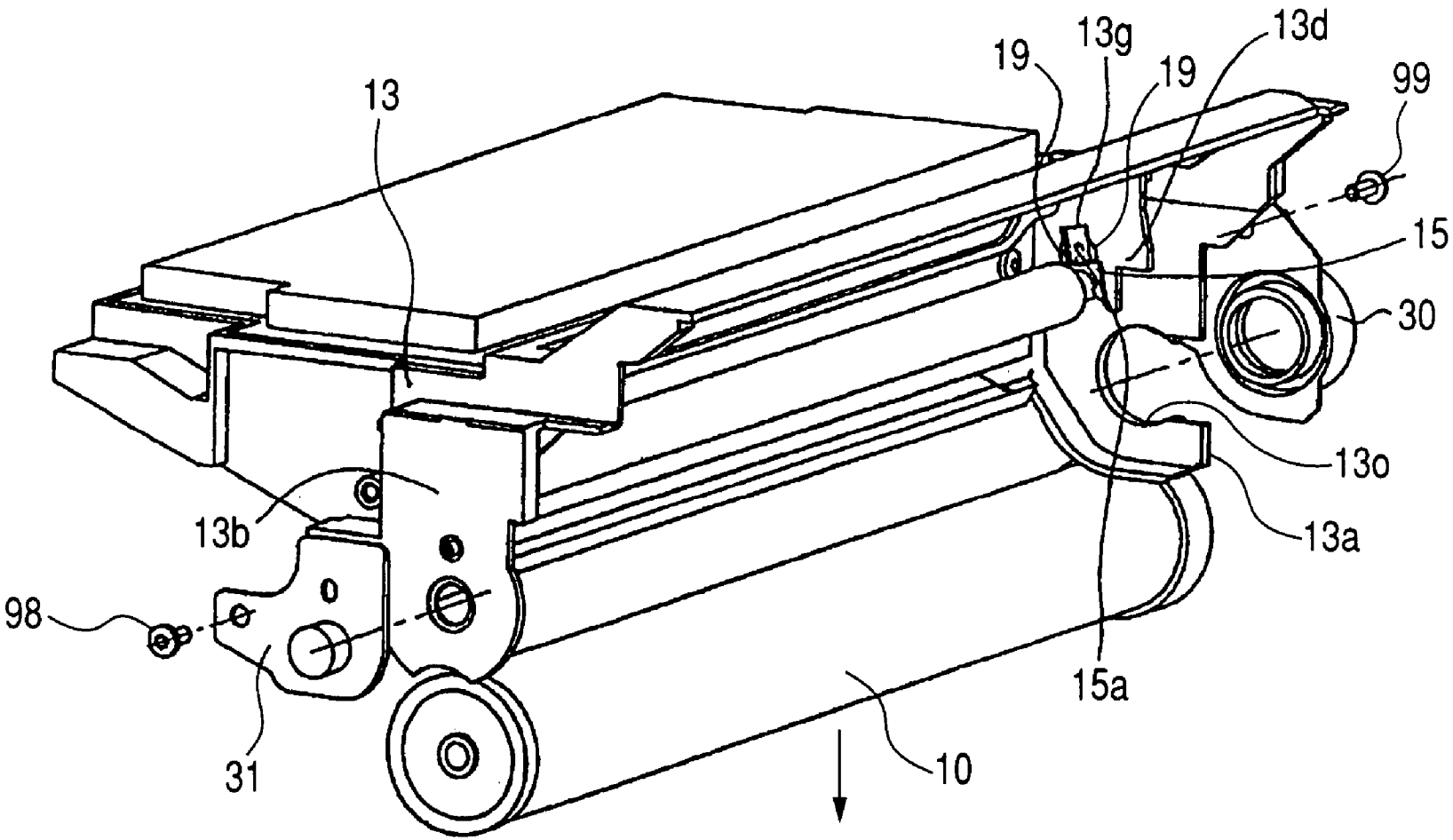
FIG. 11 is an exploded perspective view of the photosensitive member unit according to the embodiment of the present invention.

As shown in FIG. 11, to support the charging roller 11, inner walls 13*d* on the inner side of the drum frame 13 (of which the left-hand side one is omitted in the figure because of a symmetrical configuration) have bearing guides 19. Bearings 15 are movable along the bearing guides 19.

Further, one end of an urging member 82 is mounted to a boss 15*a* of each bearing 15, and the other end thereof is in contact with a seat surface 13*g* of the drum frame 13. Thus, an urging force is constantly exerted in the direction of the photosensitive drum 10.

Further, due to a stopper 19*a* provided on each bearing guide 19, there is no fear of the bearings 15 being detached from the bearing guides 19. The charging roller 11 is supported by the drum frame 13 by mounting a core 8*a* to the bearings 15, and is brought into contact with the surface of the photosensitive drum 10 by the urging members 82. Here, the urging members 82 are compression coil springs.

As shown in FIG. 2, the frame member of the drum frame 13 consists of an integral molding (not shown) of resin material, or is formed by coupling a drum lower frame 121 with a drum upper frame 122.

In this embodiment, the drum frame 13 is formed by integrating the drum lower frame 121 and the drum upper frame 122 by ultrasonic welding bonding.

Figure 13:
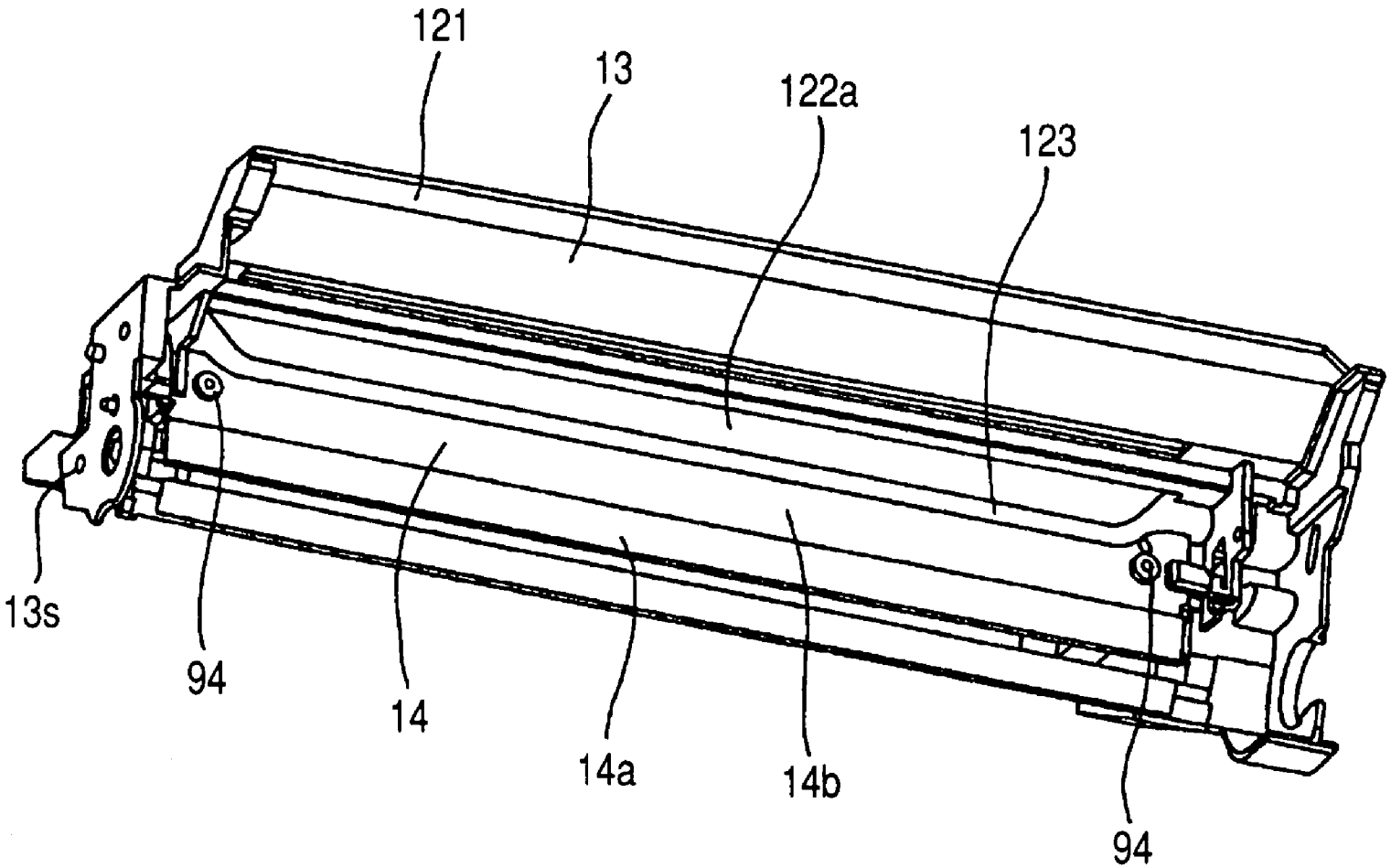
FIG. 13 is a perspective view illustrating the construction of the photosensitive member unit.

Further, as shown in FIGS. 2 and 13, the cleaning blade 14 and the drum frame 13 are arranged such that a rib 122*a* of the drum upper frame 122 covers the surface of a blade support portion 14*b* on the side where the photosensitive drum 10 is mounted. Sealing is effected by pouring foam elastomer 123 into the gap between the blade support portion 14*b* and the rib 122*a*.

Figure 14:
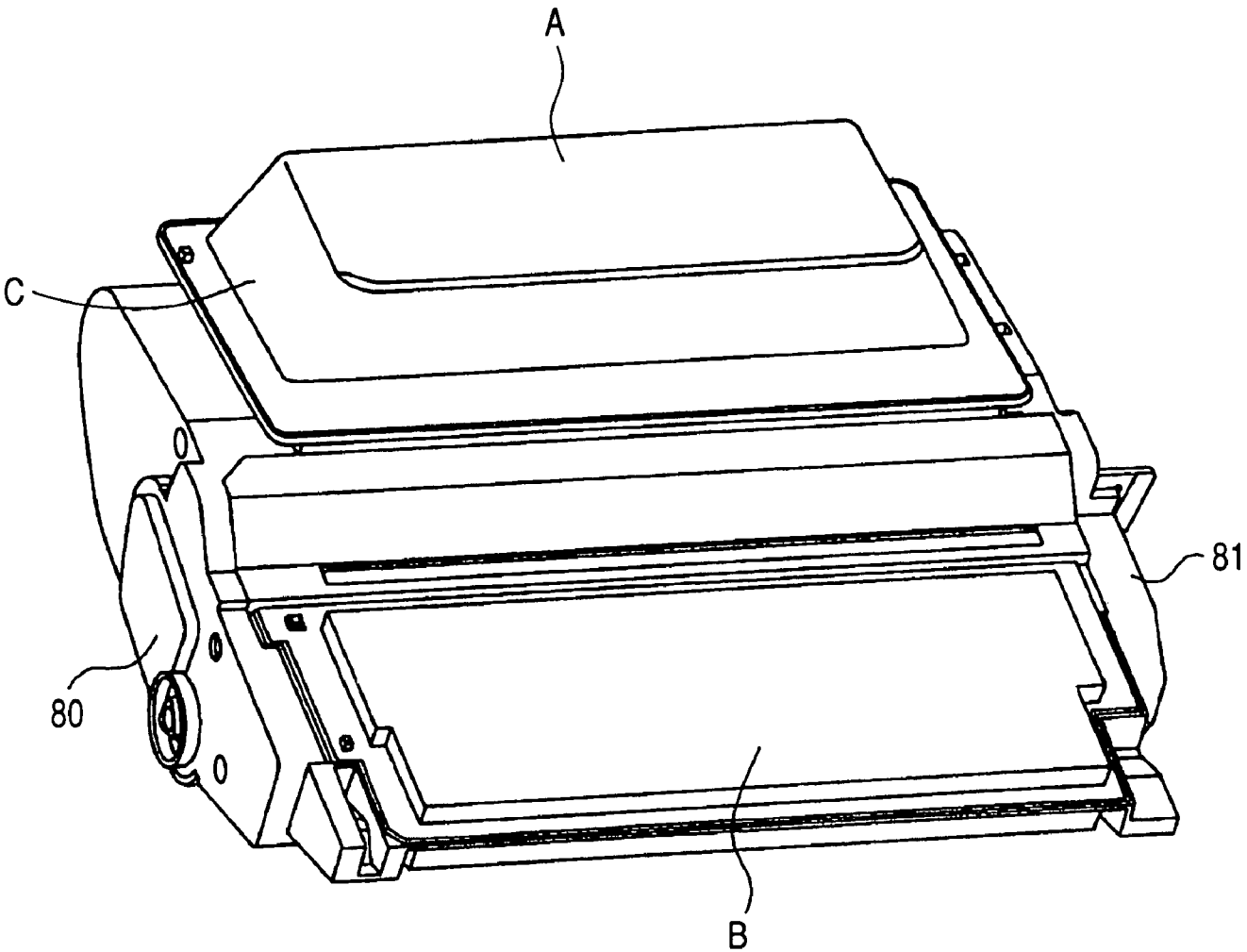
FIG. 14 is a perspective view of a process cartridge according to the embodiment of the present invention.

As shown in FIG. 14, the developing apparatus unit A and the photosensitive member unit B are placed in position by means of a first cover member 80 and a second cover member 81 on either longitudinal side surface thereof. Further, the developing apparatus unit A and the photosensitive member unit B are integrally connected with and fixed to the first cover member 80 and the second cover member 81 by means of screws and resin bonding described below to form the process cartridge C.

Figure 32:
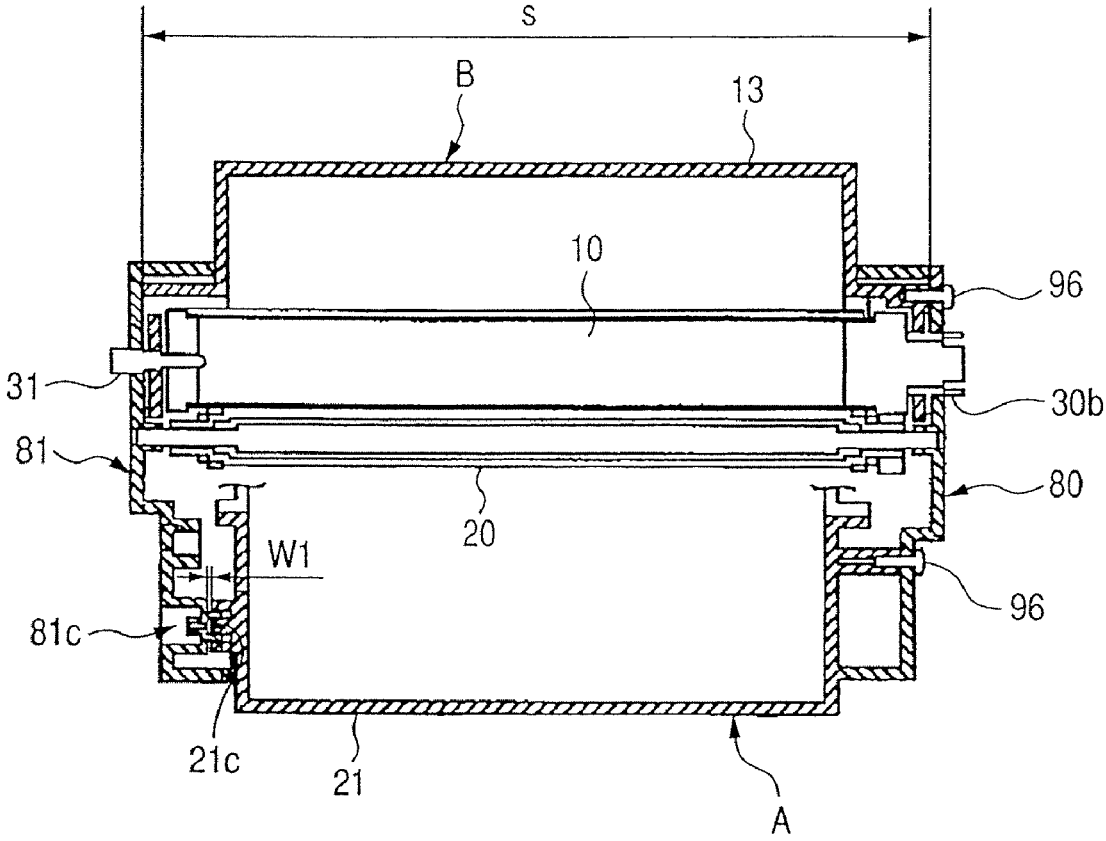
FIG. 32 is a sectional view of the process cartridge according to the embodiment of the present invention.

As shown in FIG. 32, in the longitudinal direction of the process cartridge C, the positioning of the first cover member 80 and the second cover member 81 is determined by the photosensitive member unit B. That is, the first cover member 80 and the second cover member 81 are longitudinally in contact with the photosensitive member unit B by a dimension S. In contrast, while the developing apparatus unit A is longitudinally in contact with the first cover member 80, there is a gap of a dimension W1 between the developing apparatus unit A and the second cover member 81. This is, as stated above, due to the fact that the positioning of the first cover member 80 and the second cover member 81 is determined by the photosensitive member unit B. Thus, to bond the developing apparatus unit A and the second cover member 81, molten resin is preferably poured into a bonding portion 81*c* to fill the gap. Further, taking into account the operational efficiency, the second cover member 81 and the photosensitive member unit B are preferably also bonded by molten resin (hereinafter referred to as resin bonding). This makes it possible to uniformly effect the bonding of the second cover member 81 to the developing apparatus unit A and the photosensitive member unit B by resin bonding. A detailed description of the resin bonding will be given below.

(Method of Assembling the Developing Apparatus Unit A)

A method of assembling a part of the developing apparatus unit A according to this embodiment of the present invention will be described.

First, a method of fusion-bonding the developing roller frame 50 and the developer frame 21 will be described with reference to FIGS. 6, 15, 16A, and 16B.

The developing roller frame 50 has the fusion-bonding ribs 50*e* and 50*f* on the upper and lower sides of the opening 50*g* thereof. Fusion portions 50*h* are provided at the distal ends of the fusion-bonding ribs 50*e* and 50*f* (FIG. 6A). On the upper and lower sides of the opening 21*k* of the developer frame 21, the fusion-bonding planes 21*g* and 21*h* are provided (FIG. 6B).

Figure 15:
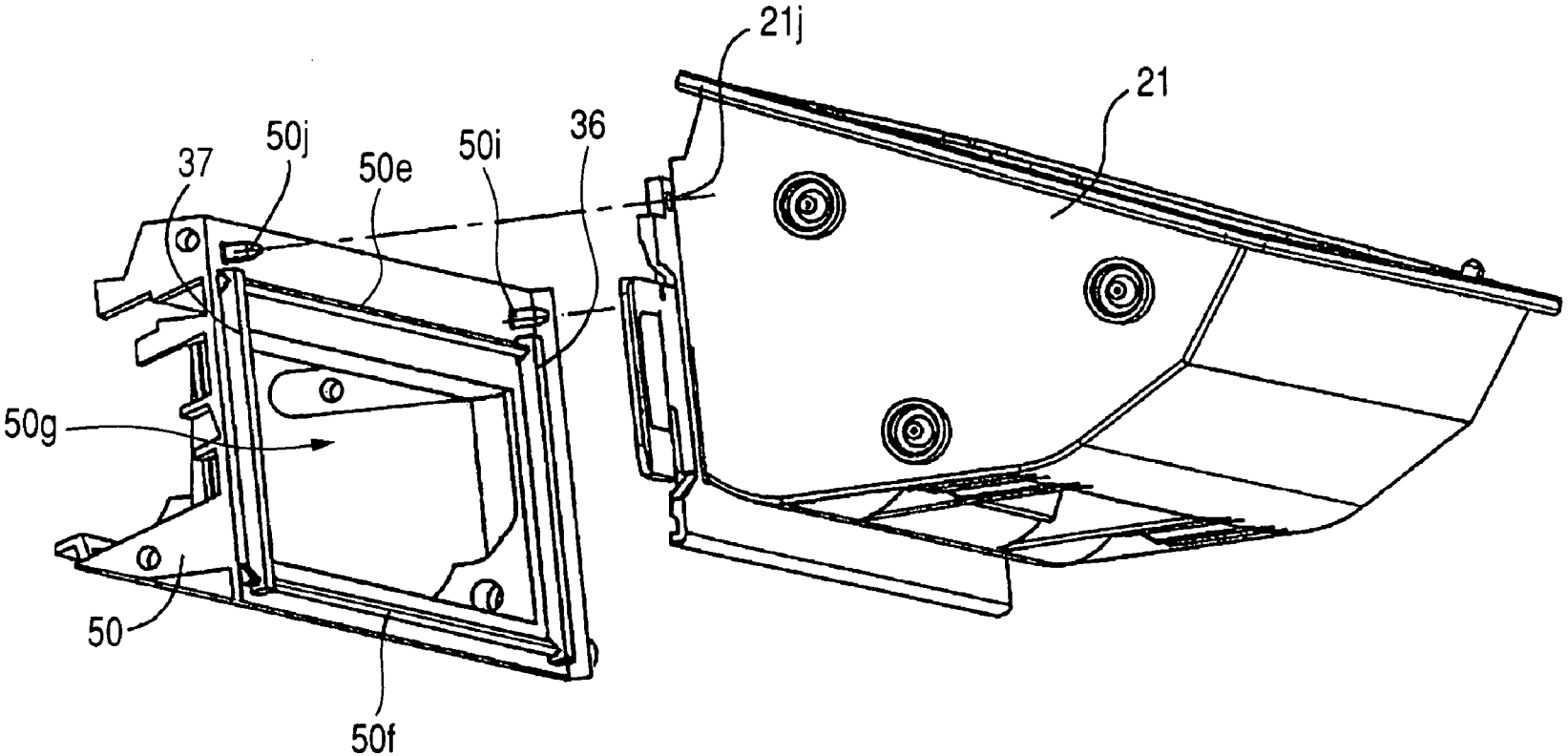
FIG. 15 is an exploded perspective view illustrating how the developing frame and the developer frame are assembled.

As shown in FIG. 15, between the developing roller frame 50 and the developer frame 21, there are provided an elastic seal member 36 at one longitudinal end and an elastic seal member 37 at the other longitudinal end so as to overlap the fusion-bonding ribs 50*e* and 50*f*. The developing roller frame 50 and the developer frame 21 are placed in position and connected together by respectively fit-engaging positioning bosses 50*i* and 50*j* of the developing roller frame 50 with positioning holes 21*i* and 21*j* of the developer frame 21.

Figure 16B:
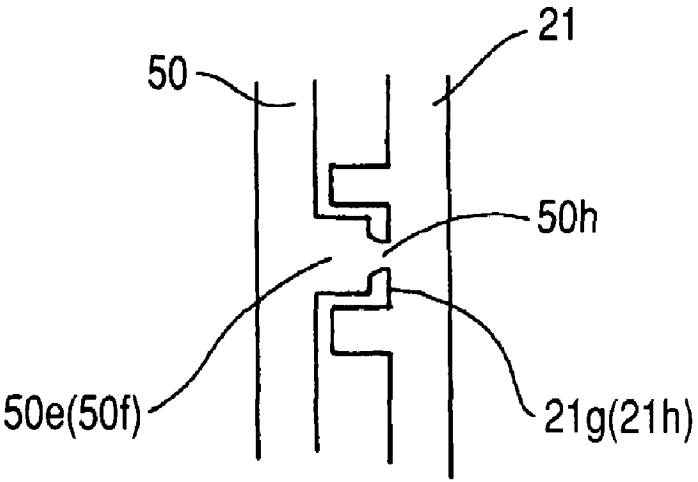
FIGS. 16A and 16B are partial sectional views illustrating a fusion-bonding portion.
Figure 16A:
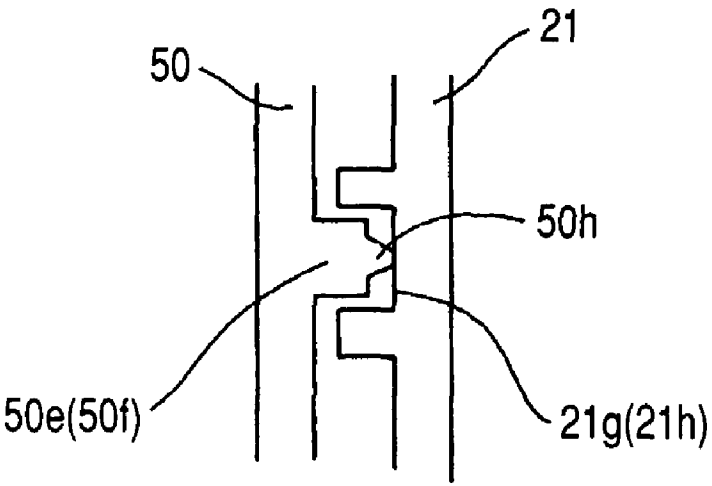

As shown in FIG. 16A, at this time, the fusion portion 50*h* at the distal end of the fusion-bonding rib 50*e* (50*f*) of the developing roller frame 50 is in contact with the fusion-bonding plane 21*g* (21*h*) of the developer frame 21. When these portions in contact with each other are caused to undergo ultrasonic vibration by an ultrasonic vibrator, the fusion portion 50*h* is fused and fusion-bonded to the fusion-bonding plane 21*g*, 21*h*, as shown in FIG. 16B. As a result, the developing roller frame 50 and the developer frame 21 are firmly connected to each other to form the developing frame.

Figure 17:
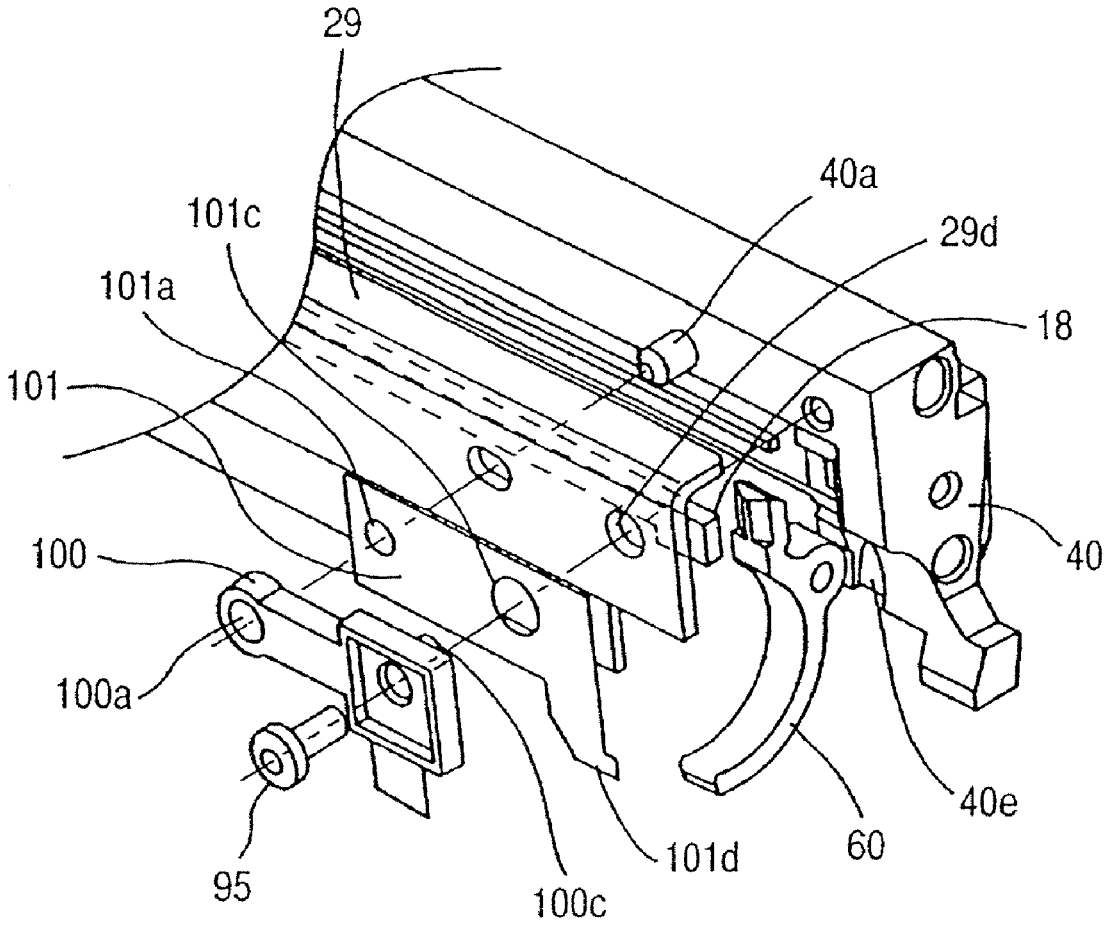
FIG. 17 is a partially exploded perspective view illustrating how a developing blade is assembled.

Next, the mounting of the magnetic seals 60 and the developing blade 29 will be described. As shown in FIG. 17, one of the magnetic seals 60 is inserted into a recess 40*e* provided at one longitudinal end of the support frame 40. Then, the magnetic seal 60 is pressurized by the developing blade 29 through the intermediation of a seal member 18. In this process, temporary positioning is effected on the magnetic seal 60. However, since the magnetic seal 60 is pressurized through the intermediation of the seal member 18, there is no fear of the magnetic seal 60 being detached from the support frame 40. A similar assembly is effected at the other longitudinal end (not shown).

(Developing Blade Mounting Process)

Figure 18:
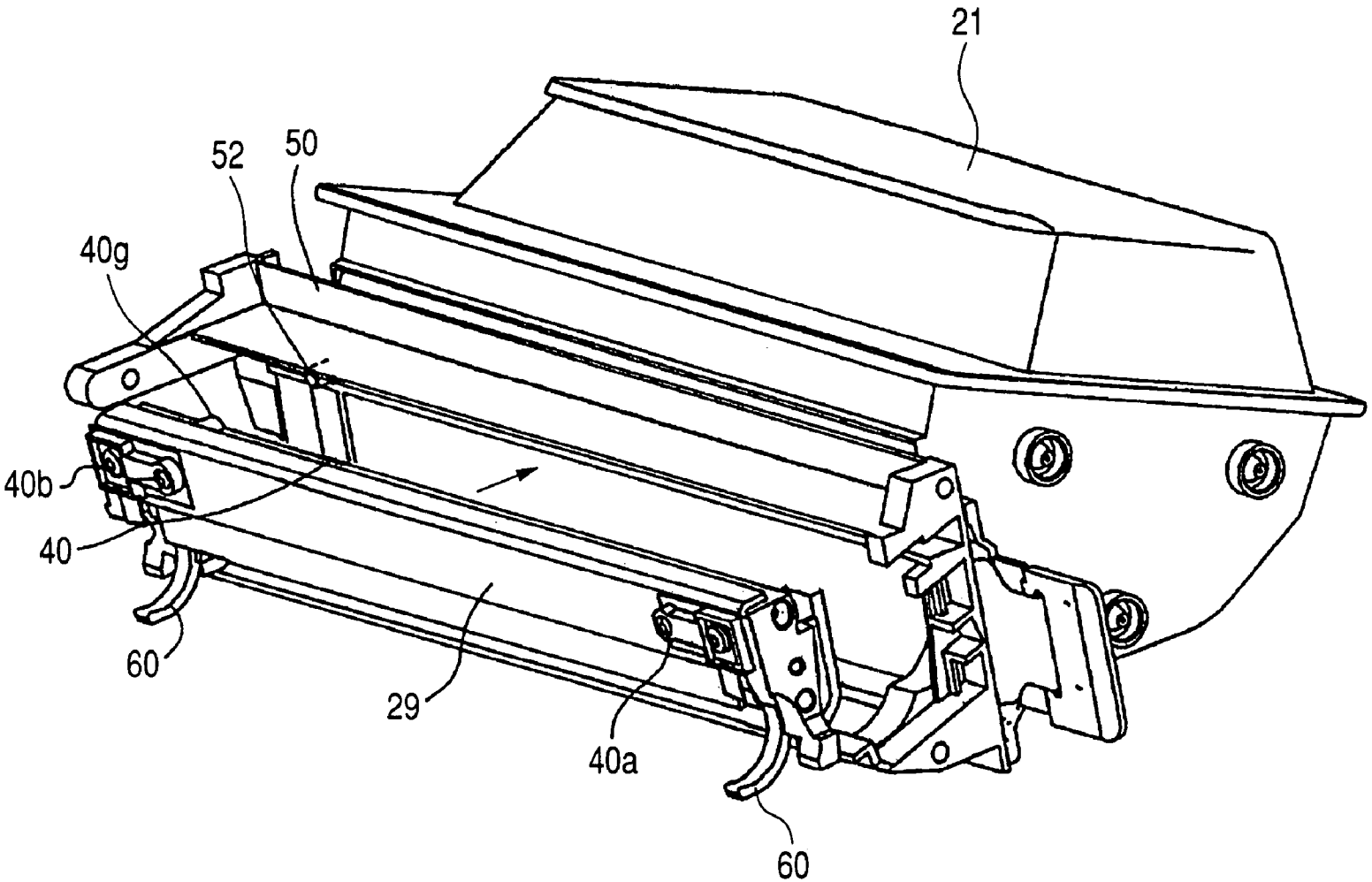
FIG. 18 is an exploded perspective view illustrating how a support frame is assembled.

As shown in FIG. 17, positioning is effected on the developing blade 29 by fit-engaging it with positioning bosses 40*a* and 40*b* (the latter of which is shown in FIG. 18) of the support frame 40.

A toner regulating member 100 is placed in position by fit-engaging a positioning rib 100*c* with a fixation hole 29*d* of the developing blade 29 and by fit-engaging a positioning hole 100*a* with the positioning boss 40*a* of the support frame 40.

A scraper 101 is placed in position by fit-engaging positioning holes 101*a* and 101*c* respectively with the positioning boss 40*a* of the support frame 40 and the positioning rib 100*c* of the toner regulating member 100.

The developing blade 29, the toner regulating member 100, and the scraper 101 are collectively fastened to the support frame 40 by a common screw 95. A similar assembly is conducted on the other side (not shown).

(Support Frame Installation Process)

As shown in FIG. 18, a positioning hole 40*g* of the support frame 40 is fit-engaged with a positioning boss 52 of the developing roller frame 50 to thereby effect longitudinal positioning. Then, the support frame 40 is installed at the opening of the developing roller frame 50.

(Developing Roller Fixation Process)

Figure 19:
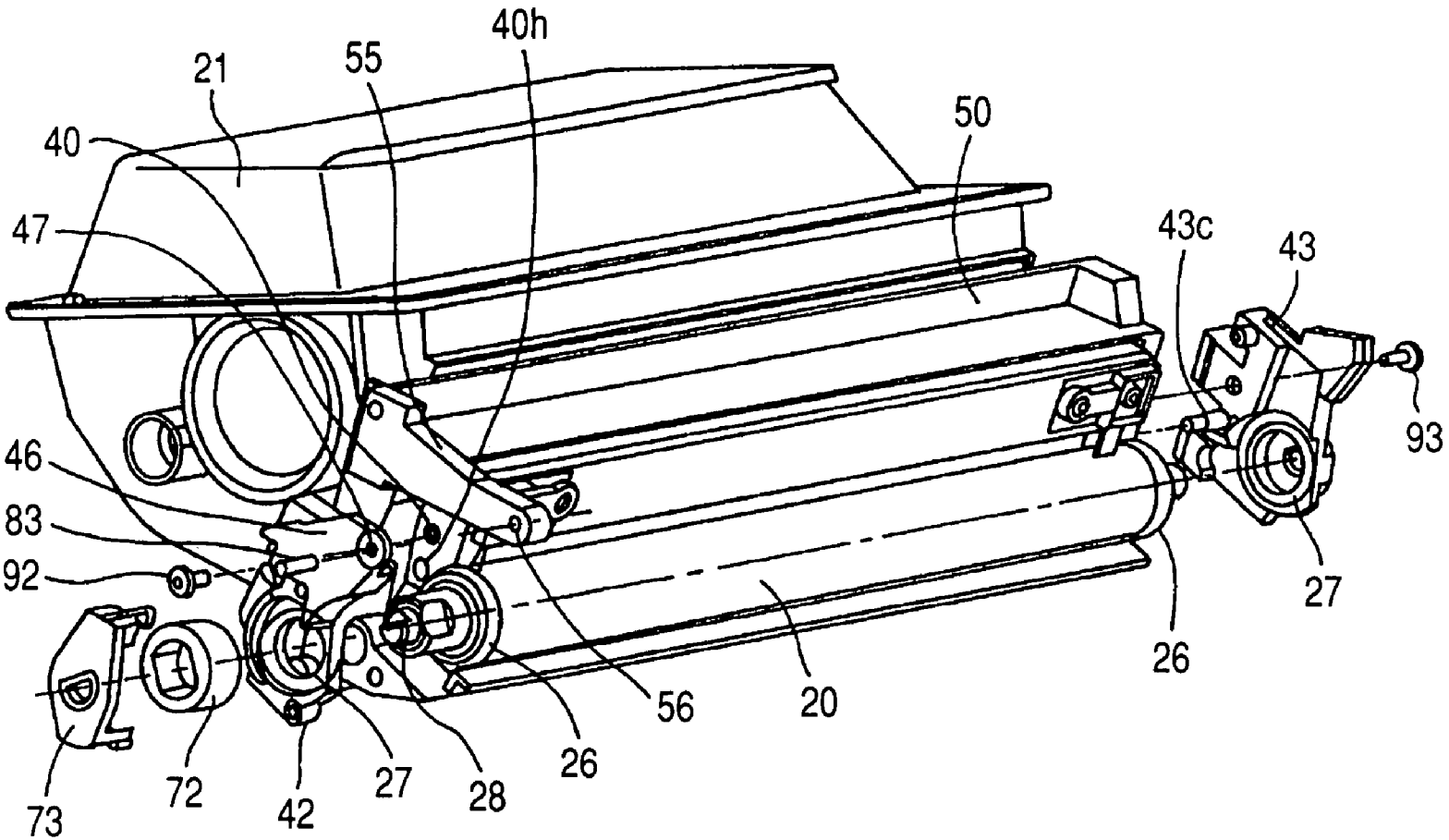
FIG. 19 is an exploded perspective view illustrating how a developing roller is assembled.

As shown in FIG. 19, the developing roller 20 with spacer runners 26 rotatably provided at both ends thereof is arranged on the support frame 40. Then, a first end cover 42 with a bearing 27 installed therein is fixed to one end of the support frame 40 by fit-engaging a positioning boss (not shown) with a positioning hole 40*h* of the support frame 40 and fastening them by a screw 92. Similarly, a second end cover 43 with the bearing 27 installed therein is fixed to the other end of the support frame 40 by fit-engaging a positioning boss 43*c* with a positioning hole (not shown) of the support frame 40 and fastening them by a screw 93. At this time, both ends of the developing roller 20 are rotatably secured to the first end cover 42 and the second end cover 43 respectively through the intermediation of the bearings 27.

In the developing roller fixation process, the positioning boss of the first end cover 42 and the positioning boss 43*c* of the second end cover 43 are fit-engaged with positioning holes 60*b* (see FIG. 5) of the magnetic seals 60, thereby effecting positioning on the magnetic seals 60.

Thereafter, a developing roller gear 72 is inserted into one end portion of the developing roller 20, and a fixation member 73 is secured in position on the first end cover 42.

(Support Frame Connection Process)

The rocking hole 47 provided in the rocking arm 46 of the first end cover 42 is rotatably connected with a fixation hole 56 provided in the support arm 55 of the developing roller frame 50 by means of a fixation pin 83.

(Method of Assembling the Process Cartridge C)

Figure 20:
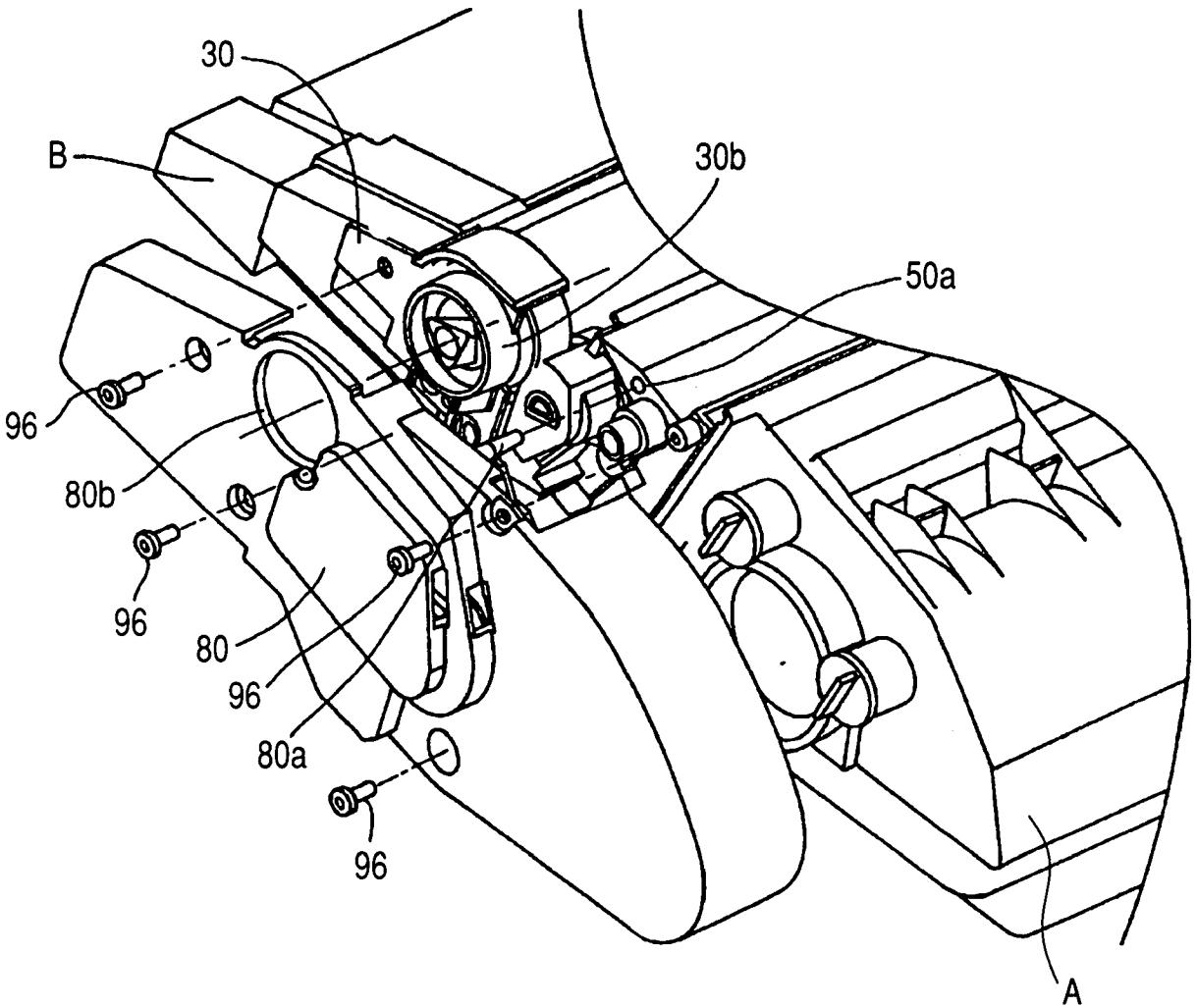
FIG. 20 is a partial perspective view illustrating a portion where a first cover member, a developing apparatus unit, and a photosensitive member unit are connected together.
Figure 21:
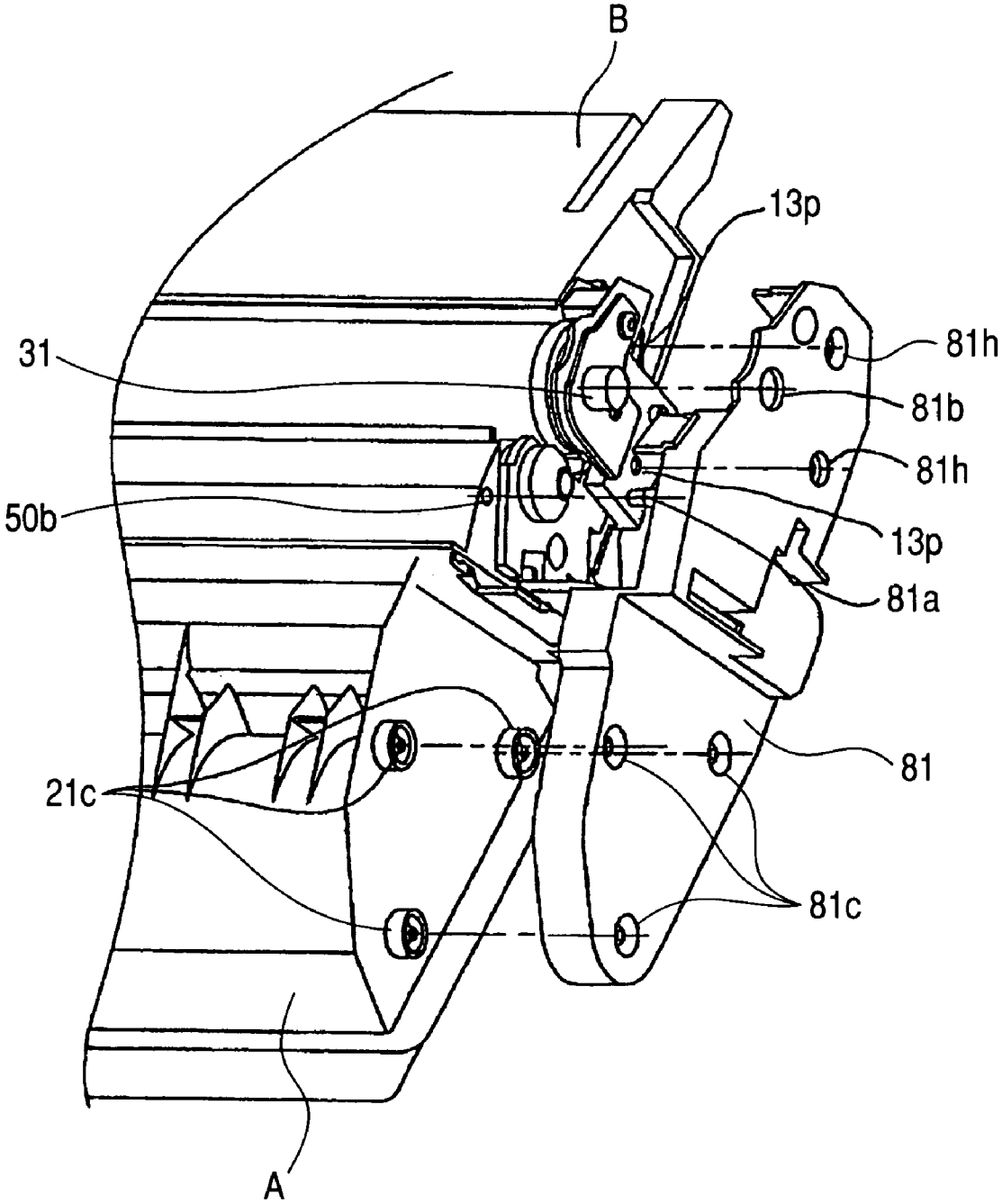
FIG. 21 is a partial perspective view illustrating a portion where a second cover member, the developing apparatus unit, and the photosensitive member unit are connected together.

As shown in FIGS. 20 and 21, the developing apparatus unit A and the photosensitive member unit B are installed so as to face each other.

A pin 80*a* for placing the first cover member 80 in position on the developing apparatus unit A is fit-engaged with a positioning hole 50*a* provided in the developing roller frame 50, and a hole 80*b* for placing the first cover member 80 in position on the photosensitive member unit B is fit-engaged with the outer diameter portion 30*b* of the drum bearing 30 of the photosensitive member unit B, whereby the positional relationship between the developing apparatus unit A and the photosensitive member unit B is determined. Thereafter, the developing apparatus unit A and the photosensitive member unit B are connected with the first cover member 80 by means of screws 96.

Similarly, a pin 81*a* for placing the second cover member 81 in position on the developing apparatus unit A is fit-engaged with a positioning hole 50*b* provided in the developing roller frame 50, and a hole 81*b* for placing the second cover member 81 in position on the photosensitive member unit B is fit-engaged with the centering shaft 31 of the photosensitive drum 10 of the photosensitive member unit B, whereby the positional relationship between the developing apparatus unit A and the photosensitive member unit B is determined. Thereafter, the developing apparatus unit A and the photosensitive member unit B are fixed to the second cover member 81 by resin bonding as follows.

As shown in FIG. 21, the second cover member 81 and the developer frame 21 have in their opposing surfaces resin bonding portions 81*c* and 21*c*. And, as described with reference to FIG. 32, molten resin 90 is poured into the gaps of the resin bonding portions 81*c* and 21*c*, whereby fixation is effected.

Figure 22C:
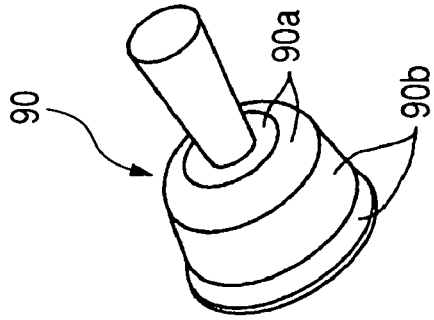
FIGS. 22A, 22B, and 22C are sectional views and a perspective view of a portion where the second cover member and the developer frame are resin-bonded.
Figure 22B:
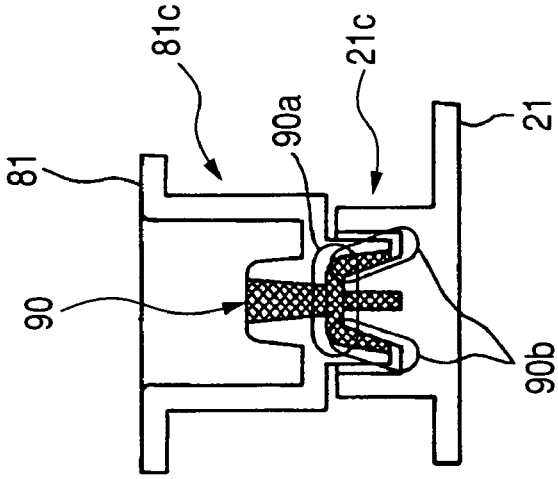
Figure 22A:
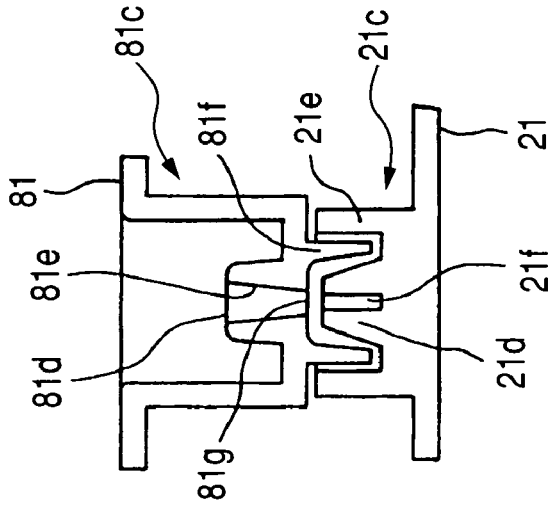

FIGS. 22A, 22B, and 22C are diagrams illustrating the construction of the resin bonding portion. FIG. 22A is a sectional view of the bonding portion, FIG. 22B is a sectional view of the bonding portion with molten resin poured therein, and FIG. 22C is a perspective view showing the configuration of the bonding resin poured.

As shown in FIGS. 22A and 22B, the resin bonding portion 81*c* of the second cover member 81 has an inlet port 81*d* for pouring molten resin 90, a pouring passage 81*e*, and a substantially cylindrical protrusion 81*f* forming the bonding portion.

Further, the resin bonding portion 21*c* of the developer frame 21 of the developing apparatus unit A has a substantially cylindrical protrusion 21*d* forming the bonding portion, a lightening portion 21*f* thereof, and a cylindrical portion 21*e* having an inner diameter larger than the outer diameter of the protrusion 81*f*.

The molten resin 90 for bonding the second cover member 81 and the developing apparatus unit A to each other is poured from the inlet port 81*d* of the second cover member 81. The poured molten resin 90 passes the pouring passage 81*e* to reach the downstream side opening 81*g*, and then forms a first bonding portion 90*a* spread in a disc-like fashion in a plane perpendicular to the pouring passage 81*e*. Thereafter, the poured molten resin 90 forms a second bonding portion 90*b* between the inner periphery of the protrusion 81*f* and the outer periphery of the protrusion 21*d*. As a result, the poured molten resin 90 attains a state as shown in FIG. 22B, whereby the second cover member 81 is firmly fixed to the developer frame 21 of the developing apparatus unit A.

Further, as shown in FIG. 21, the second cover member 81 and the drum frame 13 have in their opposing surfaces resin bonding portions 81*h* and 13*p*, and they are fixed to each other by pouring molten resin 91 into the gaps of the resin bonding portions 81*h* and 13*p*.

Figure 23A:
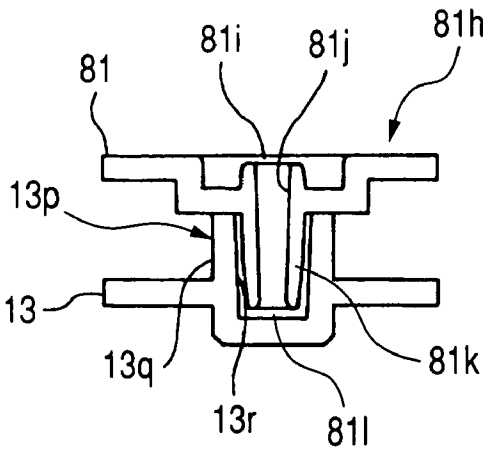
FIGS. 23A, 23B, and 23C are sectional views and a perspective view of a portion where the second cover member and the drum frame are resin-bonded.
Figure 23B:
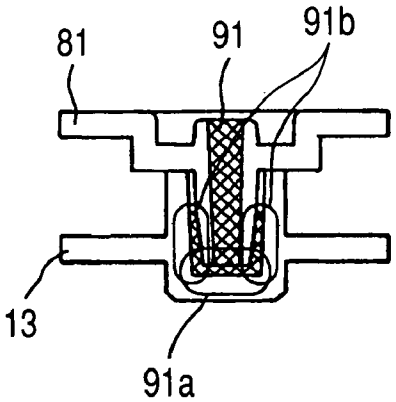
Figure 23C:
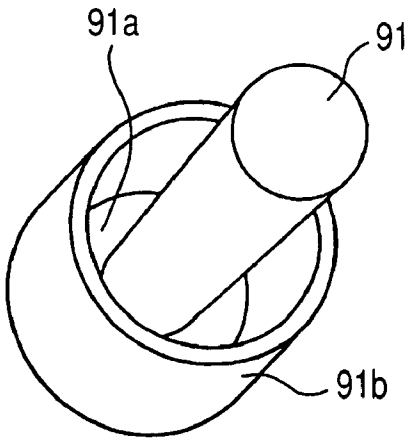

FIGS. 23A, 23B, and 23C are diagrams illustrating the construction of the resin bonding portion. FIG. 23A is a sectional view of the bonding portion, FIG. 23B is a sectional view of the bonding portion with molten resin poured therein, and FIG. 23C is a perspective view showing the configuration of the bonding resin poured.

As shown in FIGS. 23A and 23B, the resin bonding portion 81*h* of the second cover member 81 has an inlet port 81*i* for pouring molten resin 91, a pouring passage 81*j*, and a substantially cylindrical protrusion 81*k* forming the bonding portion.

Each of the resin bonding portions 13*p* of the drum frame 13 has a substantially cylindrical protrusion 13*q* forming the bonding portion, and a cylindrical portion 13*r* having an inner diameter larger than the outer diameter of the protrusion 81*k*.

The molten resin 91 for bonding the second cover member 81 and the drum frame 13 to each other is poured from the inlet port 81*i* of the second cover member 81. The poured molten resin 91 passes the pouring passage 81*j* to reach the downstream side opening 81*l*, and then forms a first bonding portion 91*a* spread in a disc-like fashion in a plane perpendicular to the pouring passage 81*j*. Thereafter, the poured molten resin 91 forms a second bonding portion 91*b* between the outer periphery of the protrusion 81*k* and the inner periphery of the protrusion 13*q*. As a result, the poured molten resin 91 attains a state as shown in FIG. 23B, whereby the second cover member 81 is firmly fixed to the drum frame 13.

In this embodiment, the second cover member 81 and the drum frame 13 are resin-bonded to each other because the second cover member 81 and the developer frame 21 are resin-bonded to each other. That is, to fill the longitudinal gap of the second cover member 81 and the developer frame 21, resin bonding is suitable. And, the connection between the second cover member 81 and the drum frame 13, which is effected on the same side as the above resin bonding with respect to the longitudinal direction, is also effected through resin bonding, whereby an improvement is achieved in the operational efficiency for the assembly.

In this embodiment, the material of the three frames bonded together, that is, the material of the second cover member 81, the developer frame 21, and the drum frame 13 is HIPS (high impact polystyrene). HIPS is also used for the molten resins 90 and 91.

The material is not restricted to this one. More preferably, however, a resin compatible with the resin of the frame to be bonded is used as the resin to be poured, whereby bonding can be performed effectively. And, it is possible to secure the components of the process cartridge C firmly to each other so that the components may not be detached from each other even when the process cartridge C suffers shock during transportation or when it is dropped.

By the above process, relative positioning is effected on the developing apparatus unit A and the photosensitive member unit B, and they are integrally connected with each other.

(Method of Dismantling the Process Cartridge C)

A method of dismantling and remanufacturing the process cartridge C according to an embodiment of the present invention will be described with reference to FIGS. 24 through 42.

(Process for Detaching the First and Second Cover Members)

Figure 24:
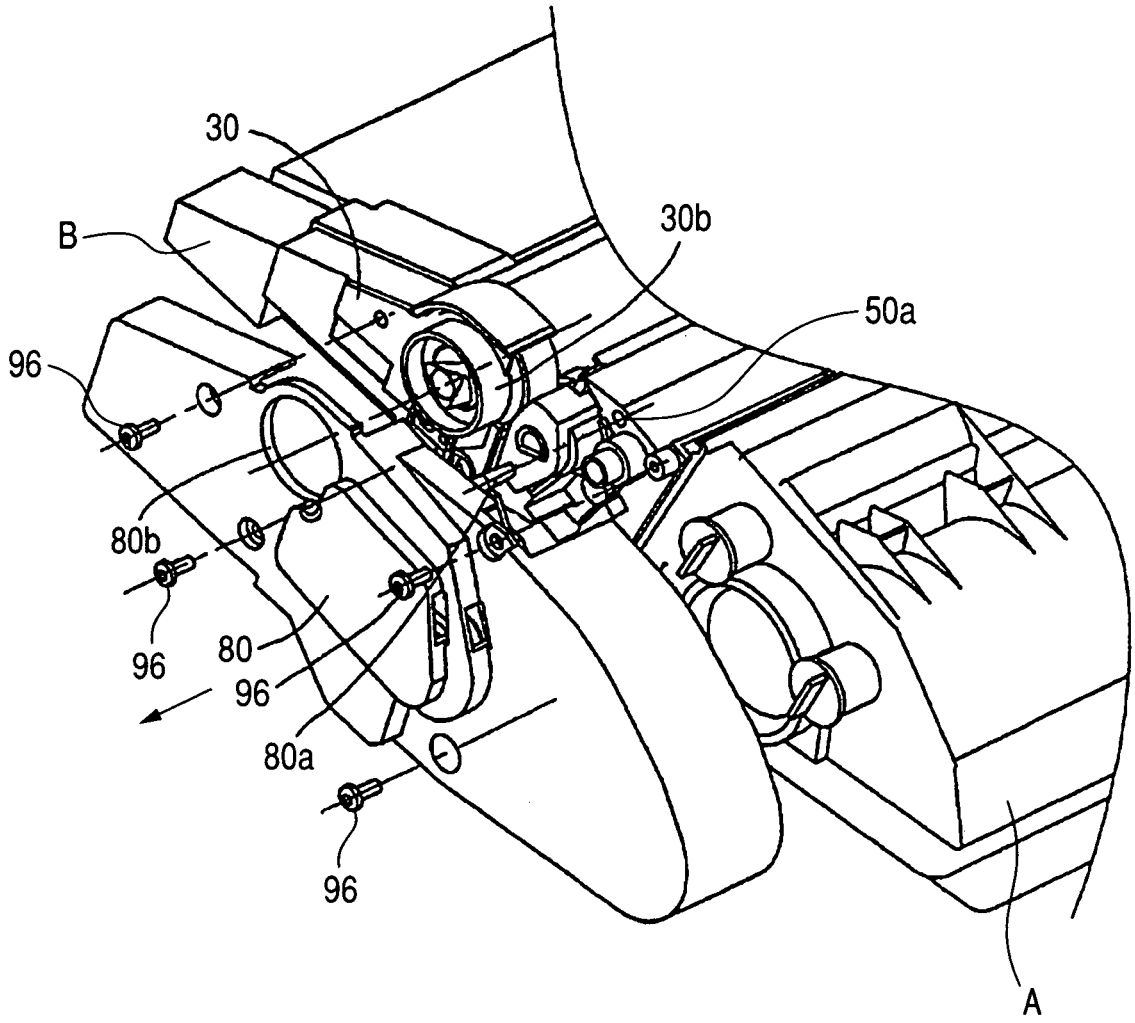
FIG. 24 is an exploded perspective view illustrating a process for detaching the first cover member.
Figure 25:
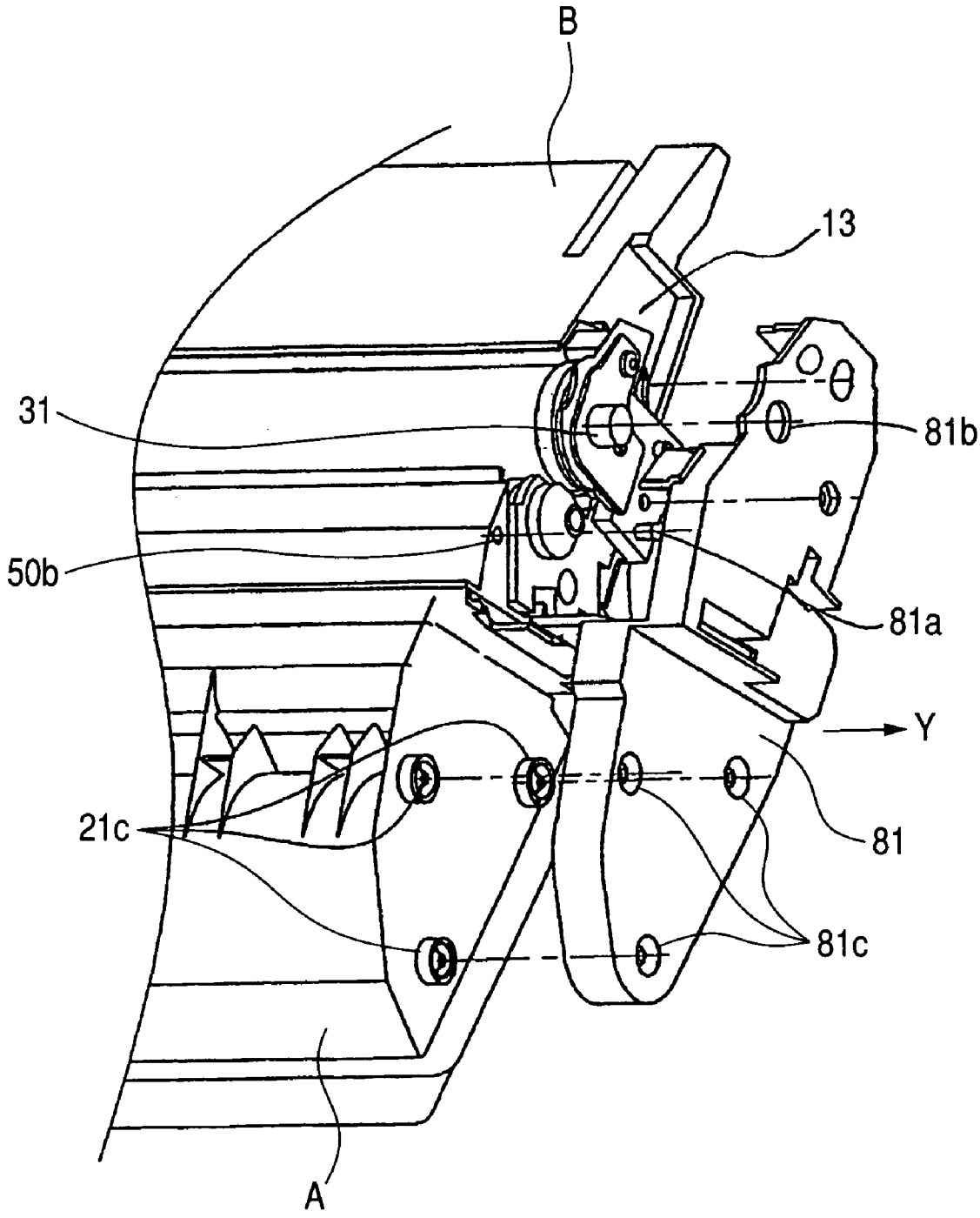
FIG. 25 is an exploded perspective view illustrating a process for detaching the second cover member.

As shown in FIGS. 24 and 25, by removing the screws 96 at one longitudinal end of the process cartridge C, the first cover member 80 is detached from the developing roller frame 50 or the developer frame 21 constituting the developing apparatus unit A, and from the drum frame 13 constituting the photosensitive member unit B.

Further, at the other longitudinal end of the process cartridge C, the resin bonding portions of the drum frame 13 and the developing roller frame 50 or the developer frame 21 are separated, thereby detaching the second cover member 81 from the photosensitive member unit B and the developing apparatus unit A.

For the separation of the resin bonding portions, the following methods are available which are shown in FIGS. 26A, 26B, and 26C and FIGS. 27A, 27B, and 27C.

Figure 26A:
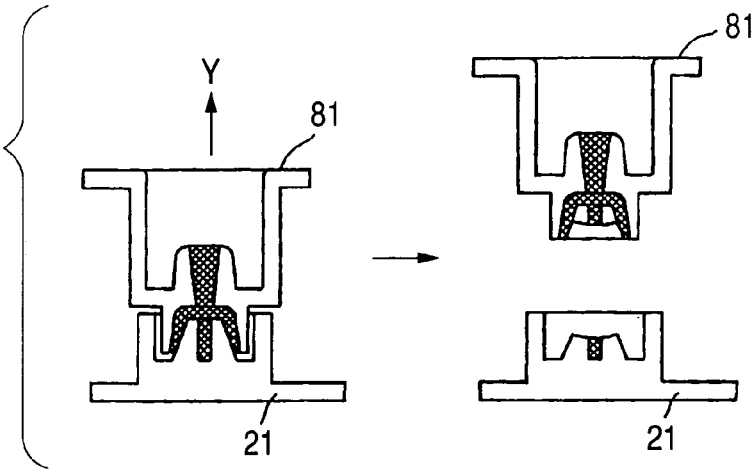
FIGS. 26A, 26B, and 26C are sectional views illustrating a method of effecting separation at a portion where the second cover member and the developer frame are resin-bonded to each other.
Figure 27A:
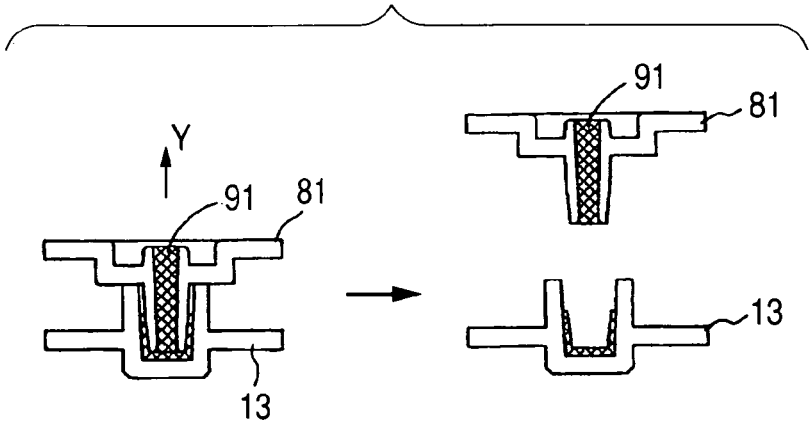
FIGS. 27A, 27B, and 27C are sectional views illustrating a method of effecting separation at a portion where the second cover member and the drum frame are resin-bonded to each other.

(1) A method in which a force in the direction indicated by the arrow Y is applied to the second cover member 81 to strip the resin bonding portion or in which the bonding resin is broken to effect separation (FIGS. 26A and 27A).

Figure 26B:
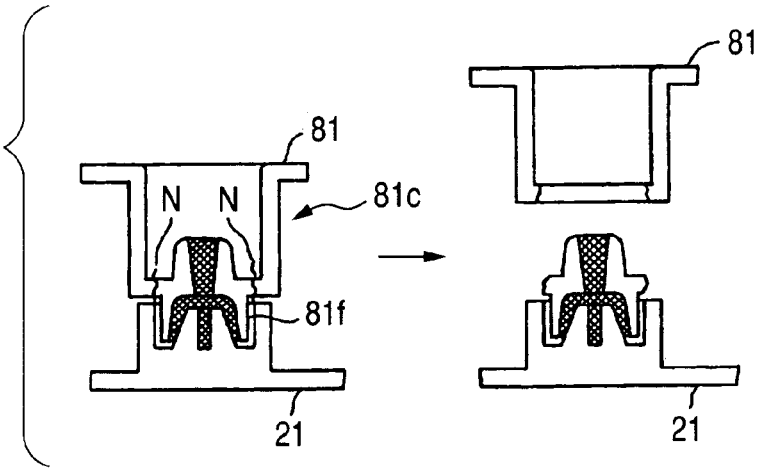

(2) A method in which the resin bonding portion 81*c* of the second cover member 81 is severed at the position indicated by wavy lines N (on the outer side of the protrusion 81*f*) (FIG. 26B).

Figure 26C:
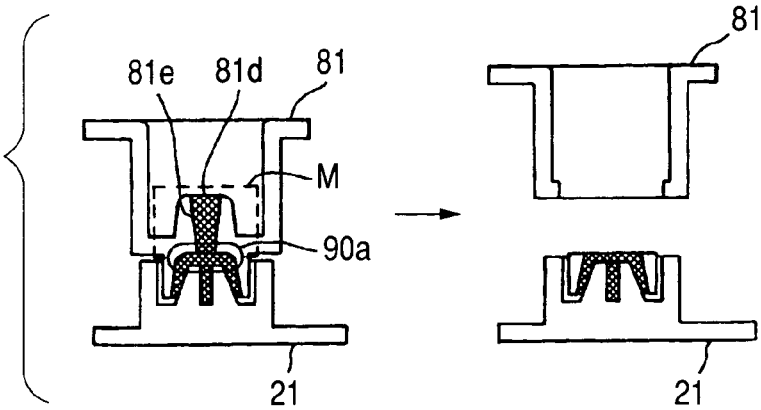

(3) A method in which the portion of the second cover member 81 starting from the pouring inlet 81*d*, continuing to the pouring flow passage 81*e*, and continuing down to the first bonding portion 90*a* (the region surrounded by a dashed line M in the drawing) is cut away to effect separation (FIG. 26C).

Figure 27B:
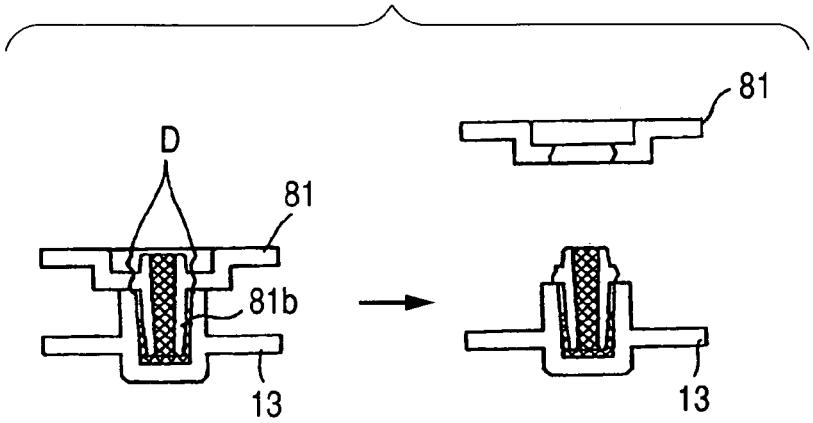

(4) A method in which the resin bonding portion 81*h* of the second cover member 81 is severed at the position indicated by wavy lines D (outside the protrusion 81*k*) (FIG. 27B).

Figure 27C:
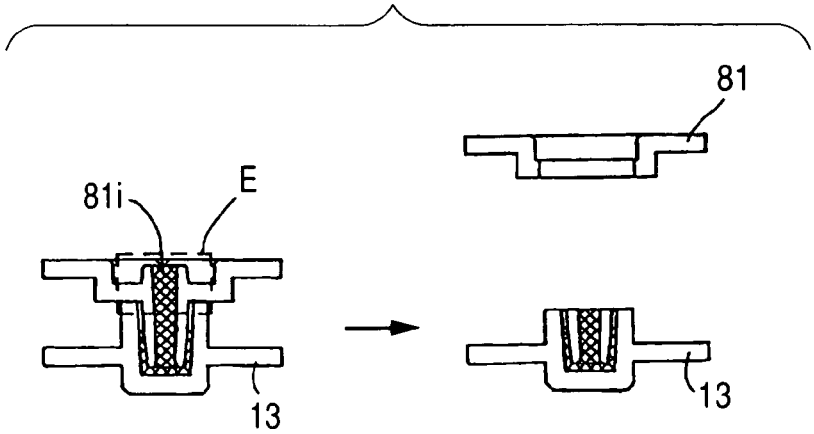

(5) A method in which the portion of the second cover member 81 starting from the pouring inlet 81*i*, continuing to the pouring flow passage 81*j*, and continuing down to the first bonding portion 91*a* (the region surrounded by a dashed line E in the drawing) is cut away to effect separation (FIG. 27C).

It should be noted that the method of separating the resin bonding portion is not restricted to the above-mentioned ones.

(Process for Separating the Developer Frame (Developing Roller Frame) and the Drum Frame)

By thus removing the first cover member 80 and the second cover member 81, the connection between the developer frame 21 (the developing roller frame 50) and the drum frame 13 is eliminated. As a result, the developing apparatus unit A and the photosensitive member unit B are separated from each other. The separation of the developing apparatus unit A and the photosensitive member unit B from each other facilitates the remanufacturing process described below.

(Method of Dismantling and Remanufacturing the Developing Apparatus Unit A)

Figure 28:
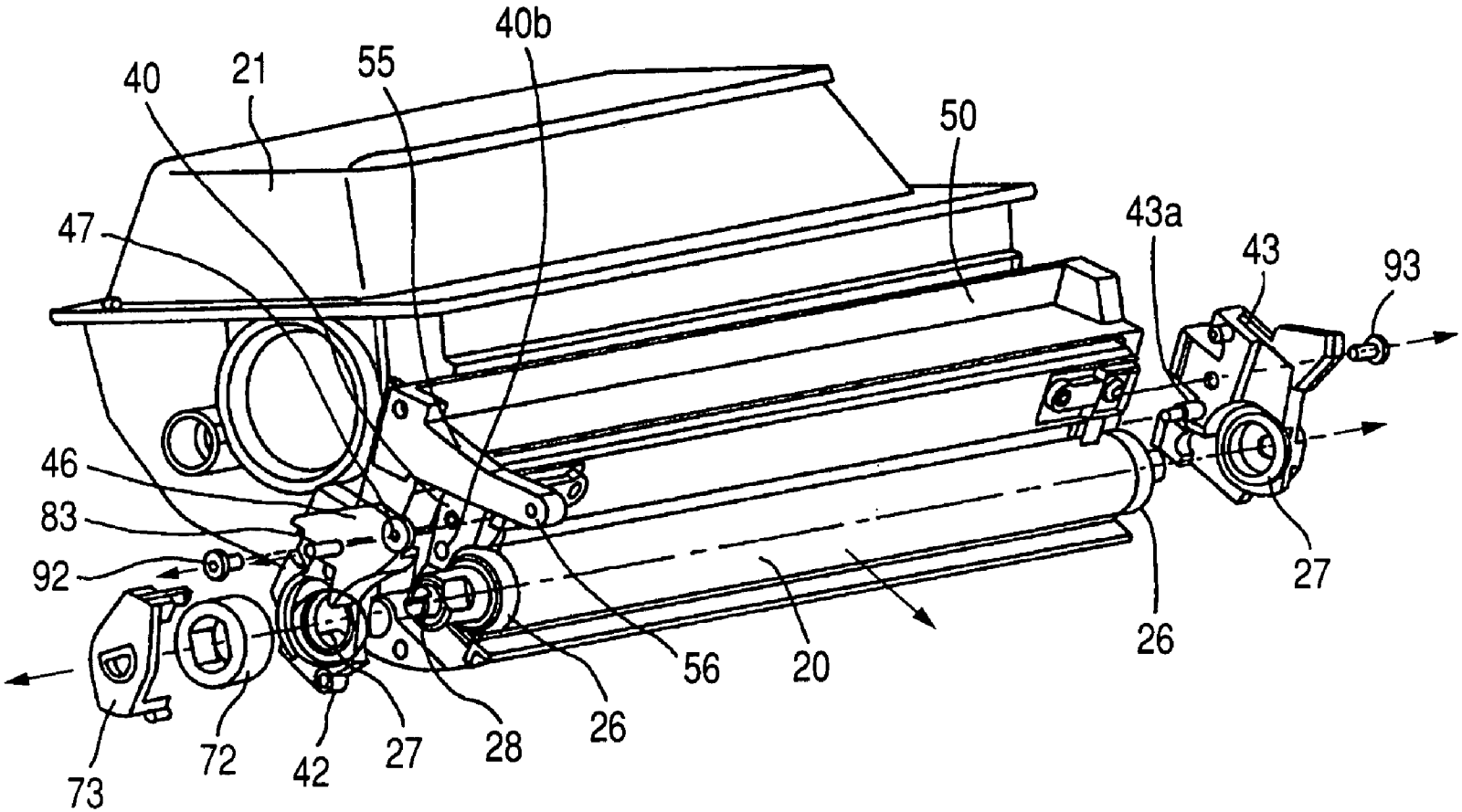
FIG. 28 is an exploded perspective view illustrating how the developing roller is detached from the developing apparatus unit.

Referring to FIG. 28, a process for detaching the developing roller 20 from the separated developing apparatus unit A will be described.

(Process for Pulling Out the Fixation Pin)

The fixation pin 83, by means of which the first end cover 42 and the developing roller frame 50 are rotatably engaged with each other, is pulled out to eliminate the connection between the developing roller frame 50 and the first end cover 42 to thereby effect separation. Further, the fixation member 73 and the developing roller gear 72, secured in position to the first end cover 42, are pulled out.

(Process for Detaching the Developing Roller)

Next, the screw 92, which fixes the first end cover 42 to the support frame 40, is removed. Then, the first end cover 42 is removed from the support frame 40 together with the bearing 27. Similarly, the screw 93, which fixes the second end cover 43 to the support frame 40, is removed. Then, the second end cover 43 is removed from the support frame 40 together with the bearing 27.

By thus removing the first end cover 42 and the second end cover 43, it is possible to remove the developing roller 20.

It is also possible to remove the developing roller 20 by removing only one of the first end cover 42 and the second end cover 43.

(Process for Detaching the Developing Blade and the Toner Regulating Member)

Next, the process for detaching the developing blade 29 from the support frame 40 will be described.

Figure 29:
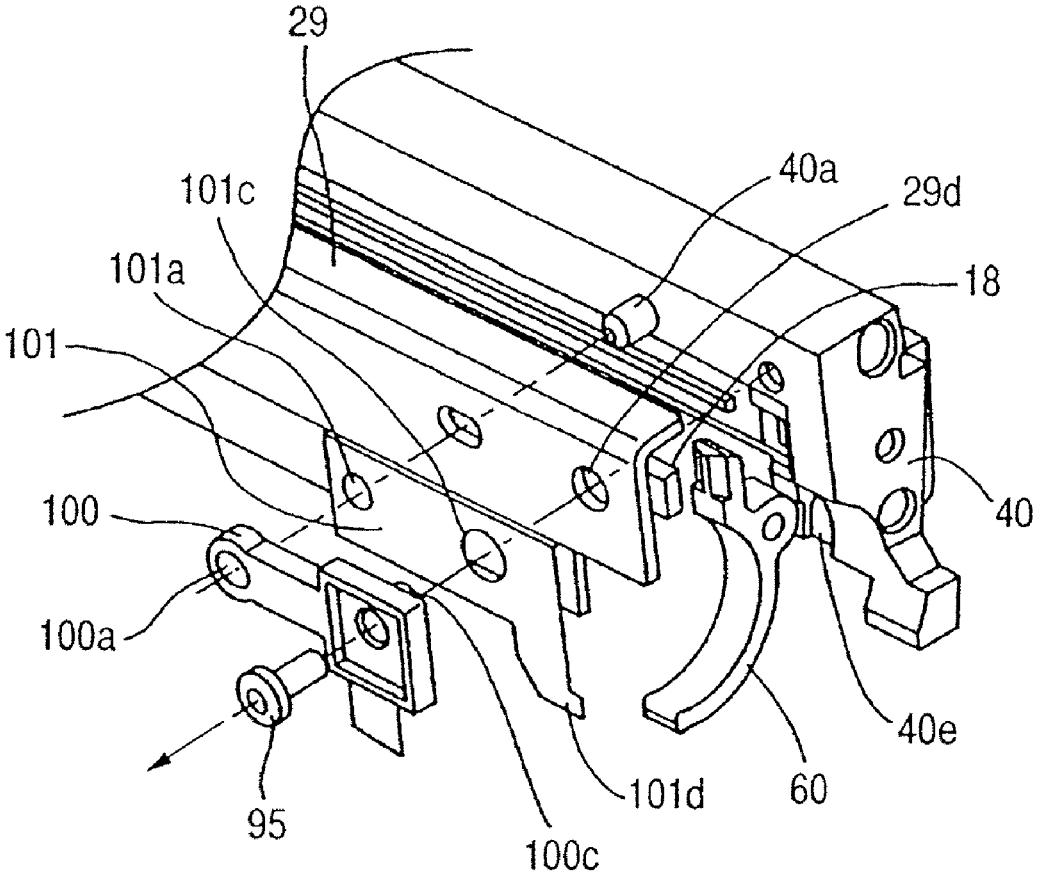
FIG. 29 is an exploded perspective view illustrating how the developing blade is detached.

As shown in FIG. 29, after the developing roller 20 is removed from the support frame 40, the screw 95, which collectively fastens the developing blade 29, the scraper 101, and the toner regulating member 100, is removed. Similar detachment of the screw 95 is performed on the longitudinally opposite side (not shown). The developing blade 29 is removed together with the scraper 101 and the toner regulating member 100. This allows replacement of components at the time of remanufacture.

(Process for Detaching the Support Frame)

Figure 30:
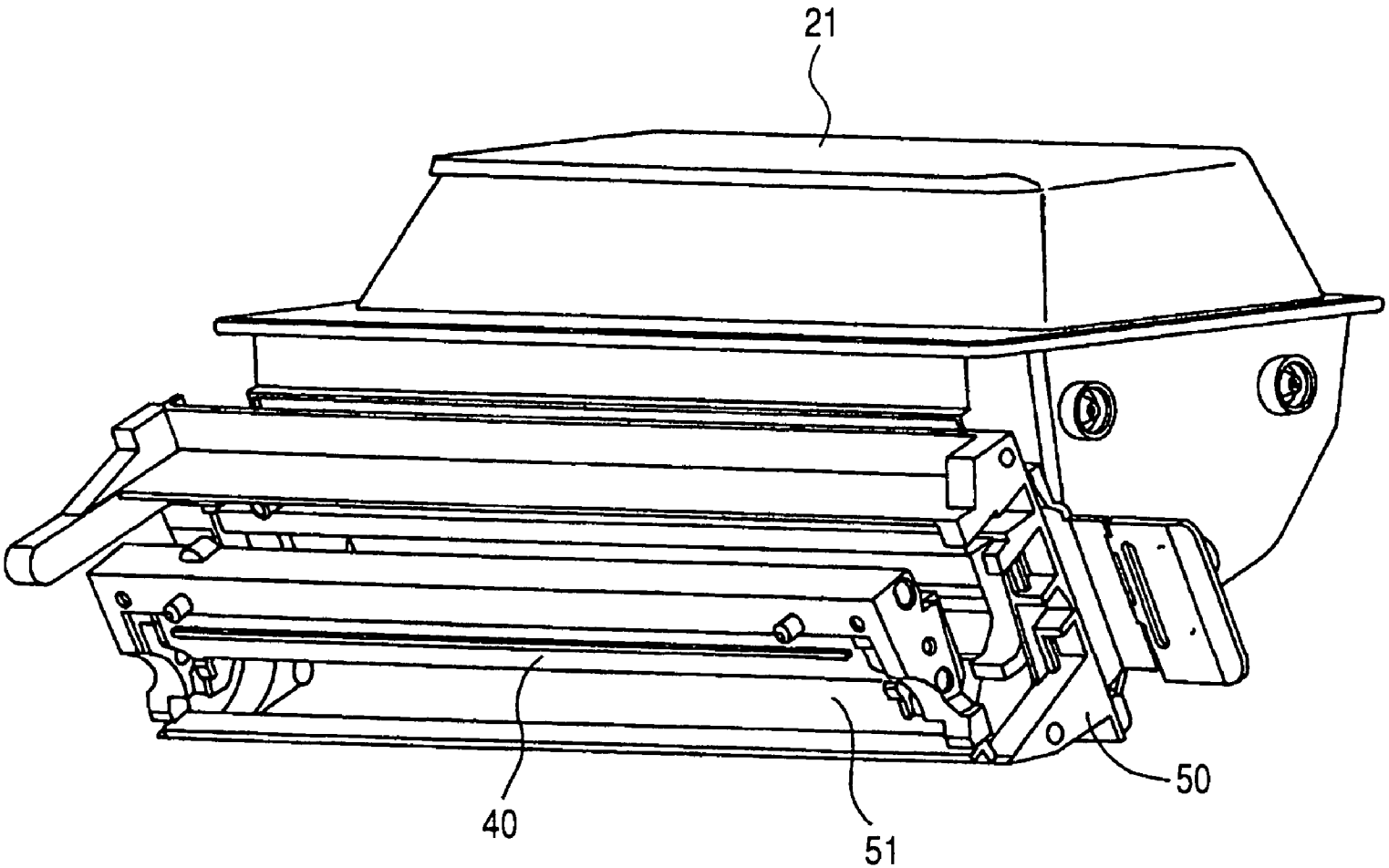
FIG. 30 is an exploded perspective view illustrating how the support frame is detached.

Next, the support frame 40, from which the developing blade 29 has been removed, is detached from the developing roller frame 50 (FIG. 30).

The detachment of the developing blade 29 may also be effected after the support frame 40 is detached from the developing roller frame 50. By detaching the support frame 40, the toner supply opening 51 can be widely exposed, thereby facilitating the developer re-filling process described below.

(Developer Re-Filling Process)

Figure 31:
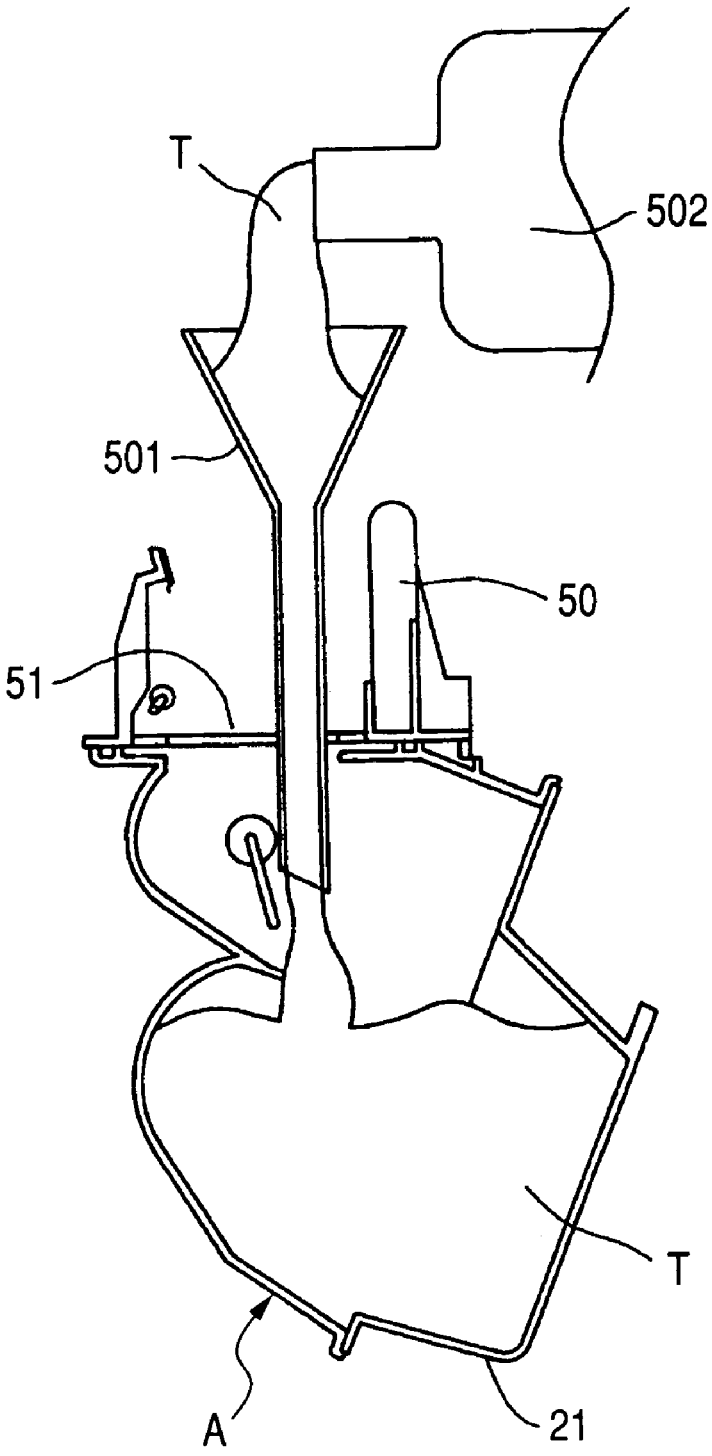
FIG. 31 is a sectional view illustrating how the developer frame is re-filled with developer.

Referring to FIG. 31, the process for refilling the developer frame 21 with developer (hereinafter referred to as toner) T will be described.

First, residual toner in the developer frame 21 is removed by suction, air blowing, or the like from the toner supply opening 51 of the developer frame 21 exposed by detaching the developing roller 20 from the support frame 40. The toner supply opening 51 is open along the longitudinal direction of the photosensitive drum 10, so that suction, air blowing, or the like can be easily effected on the toner. Then, the developer frame 21 is held such that the toner supply opening 51 is on the upper side. The distal end of a funnel 501 is inserted into the toner supply opening 51, and toner T is poured into the funnel 501 from a toner bottle 502.

In this way, the developer containing portion of the developer frame 21 is filled with toner supplied from the toner supply opening 51.

Thereafter, the toner supply opening 51 is covered with a new developer seal member to effect re-sealing, preventing leakage of toner.

It is not always necessary to effect the re-sealing of the toner supply opening 51. It is also possible to perform remanufacture without re-sealing.

Further, this toner filling process can be conducted without removing the support frame 40.

Furthermore, this toner filling process can be conducted without removing the support frame 40 and the developing blade 29.

(Developing Blade Mounting Process)

Assembly is conducted in the same manner as described above under the heading of (Process for Mounting the Developing Blade) of (Method of Assembling the Developing Unit A).

When the developing blade 29 to be mounted again to the support frame 40 is not replaced by a new one, the cleaning and inspection processes described below may be additionally performed.

Before the developing blade 29 is mounted to the support frame 40, any toner adhering thereto is removed by effecting an air blast or the like simultaneously with air suction. After the cleaning, inspection is conducted to make a judgment as to whether remanufacture is possible or not. When it is determined that remanufacture is possible, the developing blade 29 is mounted as it is. When the result of the inspection shows that its performance will not satisfy a predetermined standard, it is replaced by a new one as appropriate.

(Developing Roller Fixation Process)

Assembly is conducted in the same manner as described above under the heading of (Support Frame Installation Process) of (Method of Assembling the Developing Apparatus Unit A).

Due to the rubbing contact with the developing blade 29, the developing roller 20 may be worn. In view of this, when statistics show that it is highly possible that replacement of the developing roller 20 is necessary at the time of remanufacture of the process cartridge C, the developing roller 20 is replaced by a new one without conducting inspection, thereby achieving an improvement in operational efficiency.

However, there will be cases in which the developing roller 20 is not replaced by a new one from the viewpoint of achieving an improvement in terms of remanufacturability. In such cases, the following cleaning and inspection processes may be additionally performed.

Any toner adhering to the developing roller 20 is removed by an air blast simultaneously with air suction. Next, the developing roller 20 is inspected again to make a judgment as to whether recycling thereof is possible or not. When it is determined that it can be recycled, the developing roller 20 is mounted as it is. When the inspection result shows that its performance will not satisfy a predetermined standard, the developing roller 20 is replaced by a new one as appropriate.

Further, the inspection of the developing apparatus unit A may be conducted on each component thereof after dismantling it into the developing roller 20, the stationary magnet 28, the bearing 27, the spacer runner 26, the developing roller gear 72, and the like. In this way, it is determined what can be recycled and what cannot, replacing what cannot be recycled by new ones as appropriate.

(Support Frame Connecting Process)

Assembly is conducted in the same manner as described above under the heading of (Support Frame Connecting Process) of (Method of Assembling the Developing Apparatus Unit A).

(Method of Dismantling and Remanufacturing the Photosensitive Member Unit B)

A method of dismantling and remanufacturing the photosensitive member unit B, which has undergone the above-described (Process for Detaching the First and Second Cover Members) and (Process for Separating the Developer Frame and the Drum Frame), will be described.

(Shaft Detaching Process)

Figure 34:
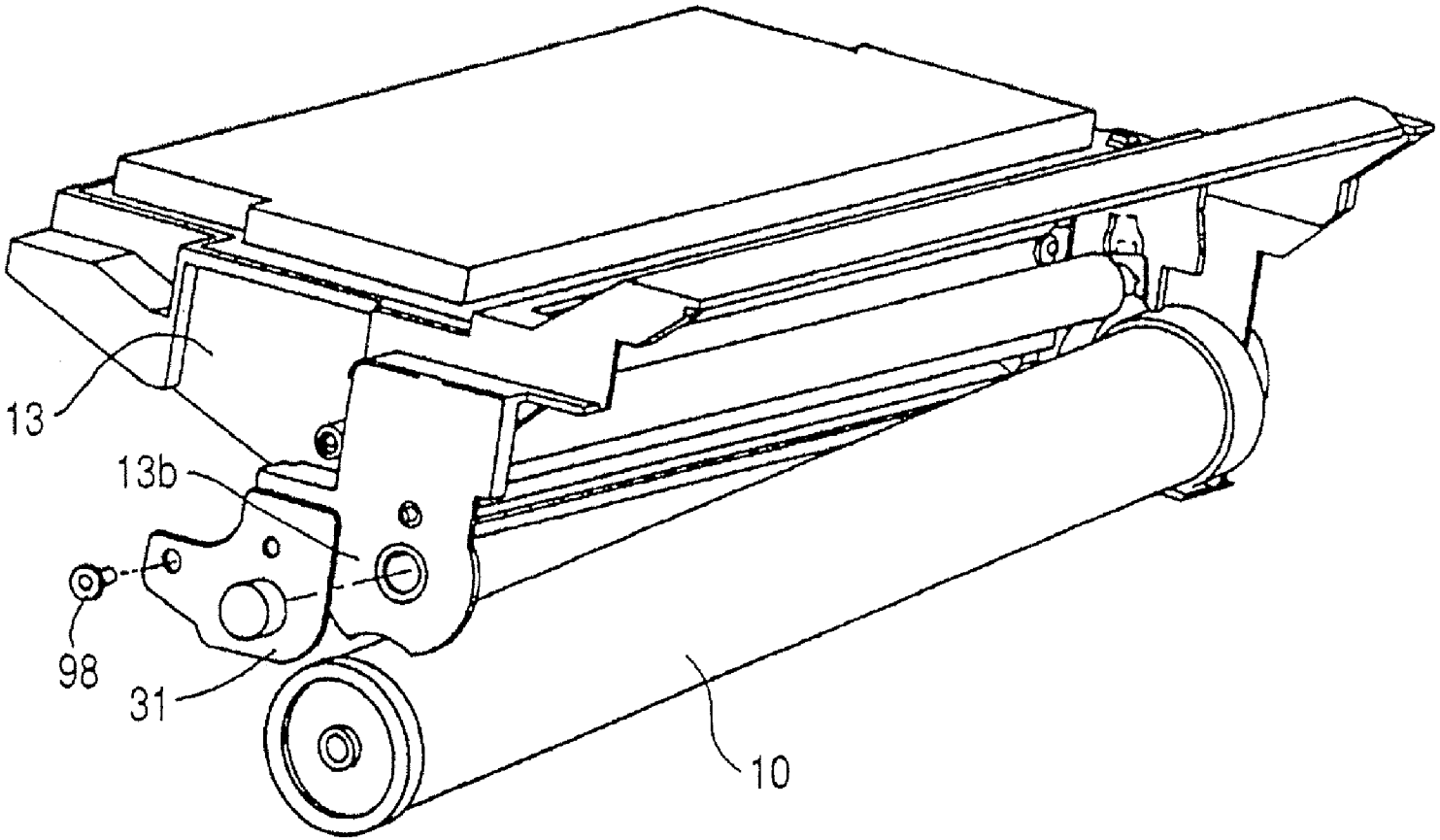
FIG. 34 is an exploded perspective view illustrating how the photosensitive drum is detached.

As shown in FIG. 34, the screw 98 is removed from the left-hand side portion 13*b* of the drum frame 13, and the centering shaft 31 is removed from the photosensitive drum 10.

(Bearing Portion Detaching Process)

Figure 33:
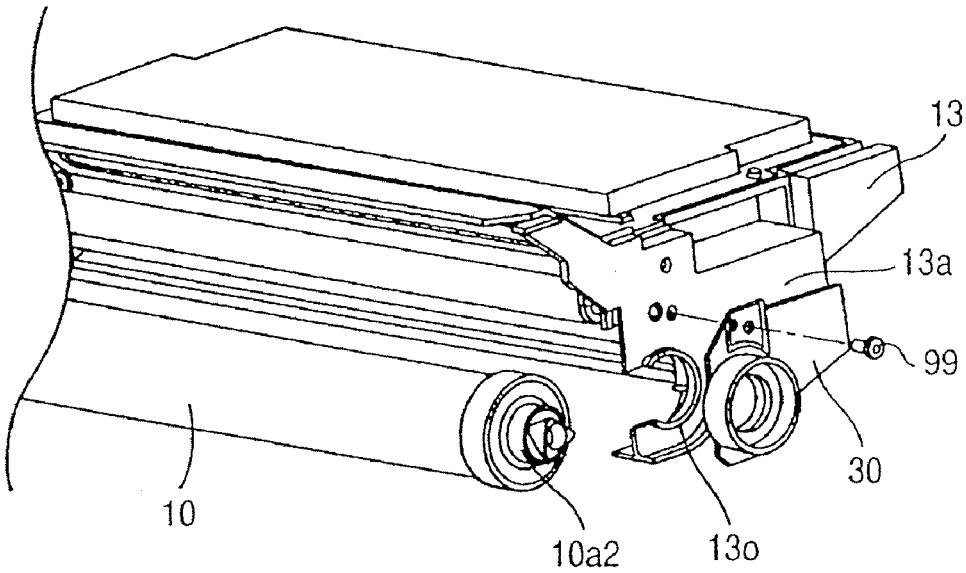
FIG. 33 is an exploded perspective view illustrating how the photosensitive drum is detached.

Similarly, as shown in FIG. 33, the screw 99 is removed from the right-hand side portion 13*a* of the drum frame 13 to remove the drum bearing 30. Either of the shaft detaching process and the bearing portion detaching processing may be conducted first.

(Photosensitive Drum Detaching Process)

By thus removing the centering shaft 31 and the drum bearing 30, it is possible to remove the photosensitive drum 10 in a direction crossing the longitudinal direction thereof.

The extraction of the photosensitive drum 10 can also be effected solely through the removal of the centering shaft 31. In this case, the process can be shortened. At this time, the photosensitive drum 10 is removed by first shifting the non-driving side thereof (see FIG. 34).

By removing the photosensitive drum 10, it is possible to perform replacement of the photosensitive drum 10 and removal of the toner contained in the waste toner container 12 as described below.

(Charging Roller Detaching Process)

Figure 35:
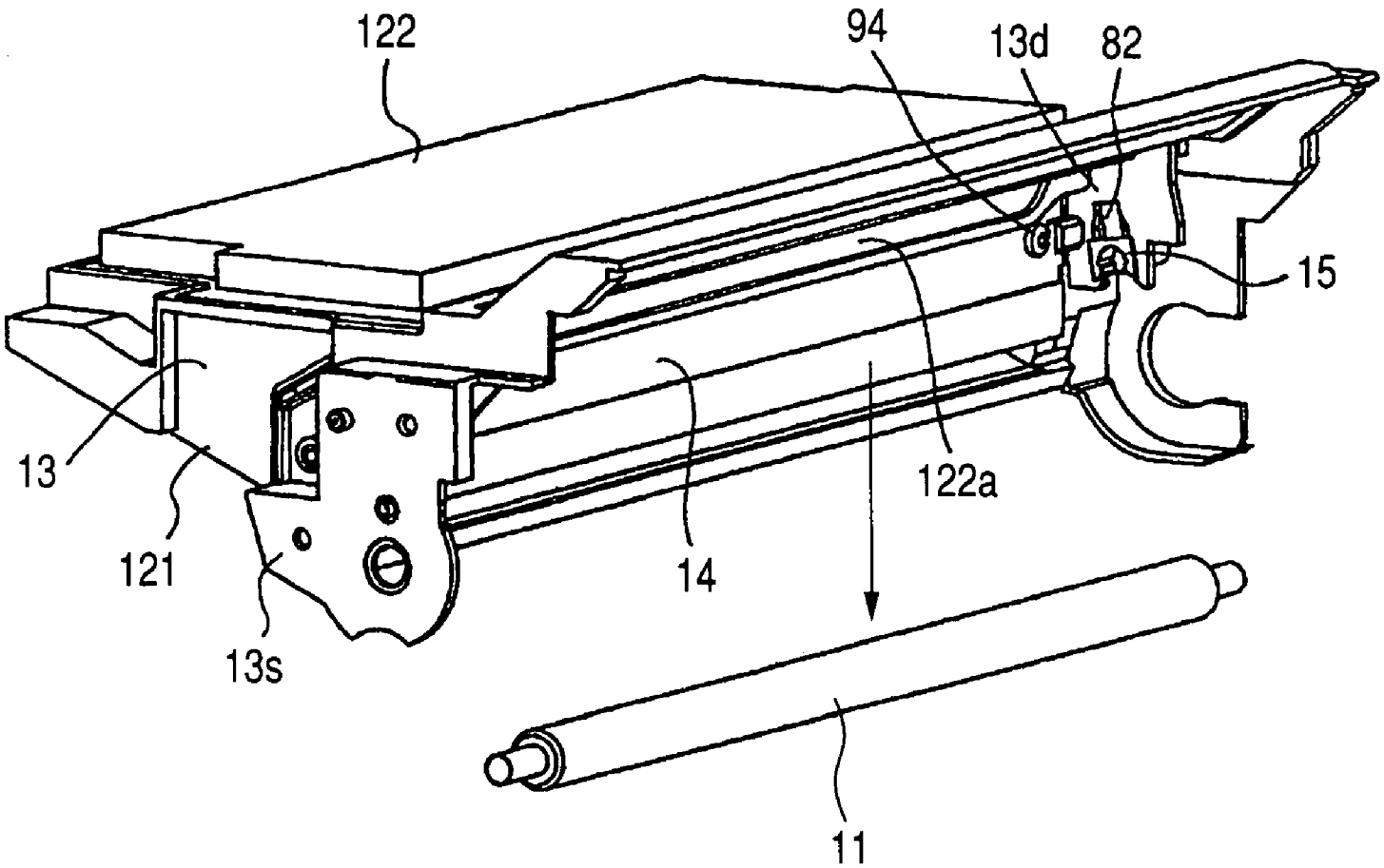
FIG. 35 is an exploded perspective view illustrating how a charging roller is detached.

As shown in FIG. 35, the charging roller 11 provided on the inner walls 13*d* is removed. At this time, the bearing 15 and the urging member 82 may be removed if necessary.

(Cleaning Blade Detaching Process)

As described above, in the drum frame 13 of this embodiment, the drum lower frame 121 and the drum upper frame 122 are integrated with each other by ultrasonic welding bonding.

Further, as shown in FIGS. 2 and 35, the cleaning blade 14 and the drum frame 13 are arranged such that the rib 122*a* of the drum upper frame 122 covers the photosensitive drum mounting side surface of the blade support portion 14*b*.

Thus, when detaching the cleaning blade 14 from the drum frame 13, the screw 94 is removed after cutting off the rib 122*a* by a tool, such as a cutter, an ultrasonic cutter, or a milling cutter (not shown).

By performing this process, the cleaning blade 14 can be detached from the drum frame 13 easily and reliably.

(Developer Removing Process)

Further, after removing the cleaning blade 14, the toner contained in the waste toner container 12, which accommodates the toner removed from the photosensitive drum 10 by the cleaning blade 14, is removed therefrom. Since the cleaning blade 14 is detached, the opening of the waste toner container 12 is large, thus facilitating the removal of the toner.

In the developer removing process, the removal of the toner from the waste toner container 12 is effected by vacuum-sucking the toner from within the waste toner container 12 or by blowing out the toner with compressed air. Further, when suction is conducted simultaneously with the supply of compressed air to the waste toner container 12, the toner is not scattered, and can be advantageously removed with rapidity.

The charging roller detaching process and the cleaning blade detaching process may be omitted if not necessary. Further, the charging roller removing process may be omitted if not necessary.

(Re-Assembly of the Photosensitive Member Unit B)

The cleaning blade 14, the charging roller 11, and the photosensitive drum 10 are mounted in this order to the drum frame 13 to assemble the photosensitive member unit B.

Figure 36:
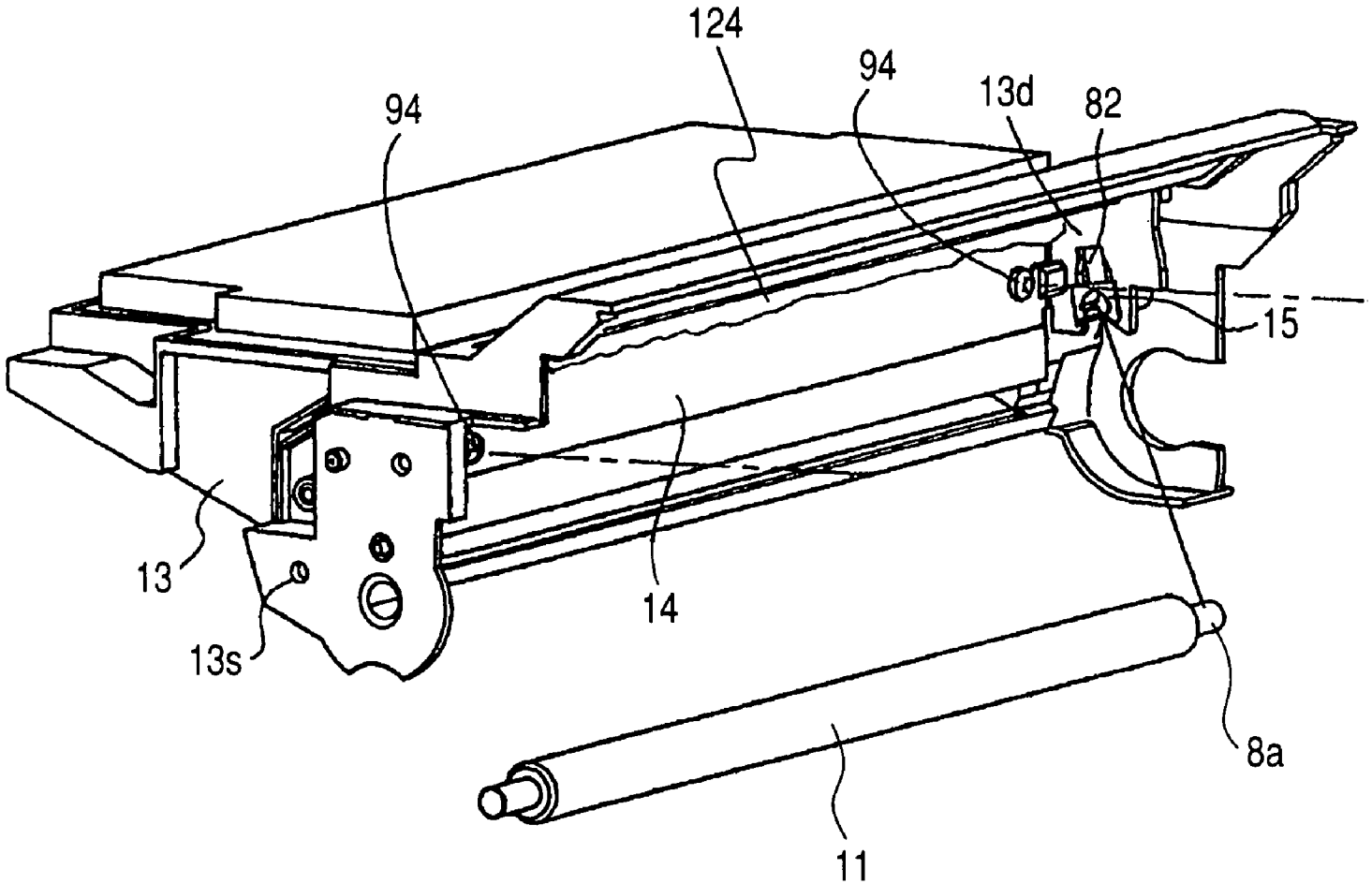
FIG. 36 is a perspective view illustrating how the photosensitive member unit is re-assembled.

The cleaning blade 14 to be recycled is one accepted based on the inspection. When it cannot be recycled, it is replaced by a new one. As shown in FIG. 36, the cleaning blade 14 is mounted to the drum frame 13 by the screws 94. Then, a fluid material 124 consisting of foam elastomer, adhesive, molten resin, or the like is poured into the gap between the drum frame 13 and the cleaning blade 14 over the entire longitudinal region thereof, thereby effecting sealing.

Next, the core 8*a* of the charging roller 11 is fit-engaged with the bearings 15. When the bearings 15 and the urging members 82 are removed in the (Charging Roller Detaching Process), the urging members 82 and the bearings 15 are fit-engaged with the bearing guides 19 (not shown) in the inner walls 13*d* of the drum frame 13, and the core 8*a* of the charging roller 11 is fit-engaged with the bearings 15.

(Photosensitive Drum Inserting Process)

Figure 37:
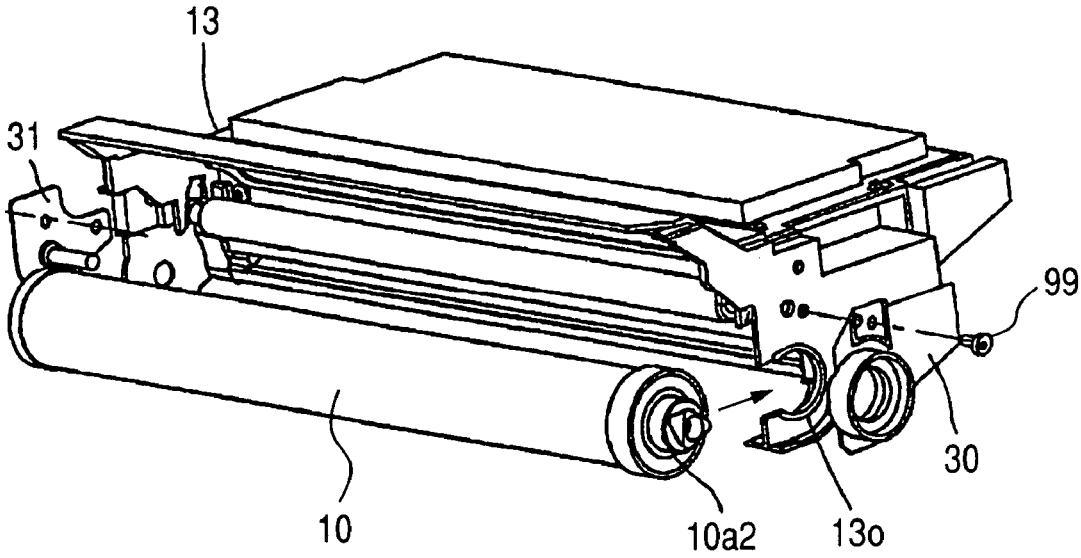
FIG. 37 is a perspective view illustrating how the photosensitive drum is mounted.

Next, as shown in FIG. 37, a new photosensitive drum 10 is inserted into the drum frame 13 in a direction crossing the longitudinal direction thereof. Here, when the photosensitive drum 10 is inserted into the drum frame 13, a shaft portion 10*a*2 provided at one end thereof enters a cutout portion 13*o* of the drum frame 13.

(Photosensitive Drum Mounting Process)

A drum bearing 30 serving as the bearing portion is mounted to one longitudinal end of the drum frame 13 by a screw 99 so that the shaft portion 10*a*2 provided at one end of the new photosensitive drum 10 may be supported. At the same time, the centering shaft 31 is mounted to one longitudinal end of the drum frame 13 so that the other end of the new photosensitive drum 10 may be supported.

Figure 38:
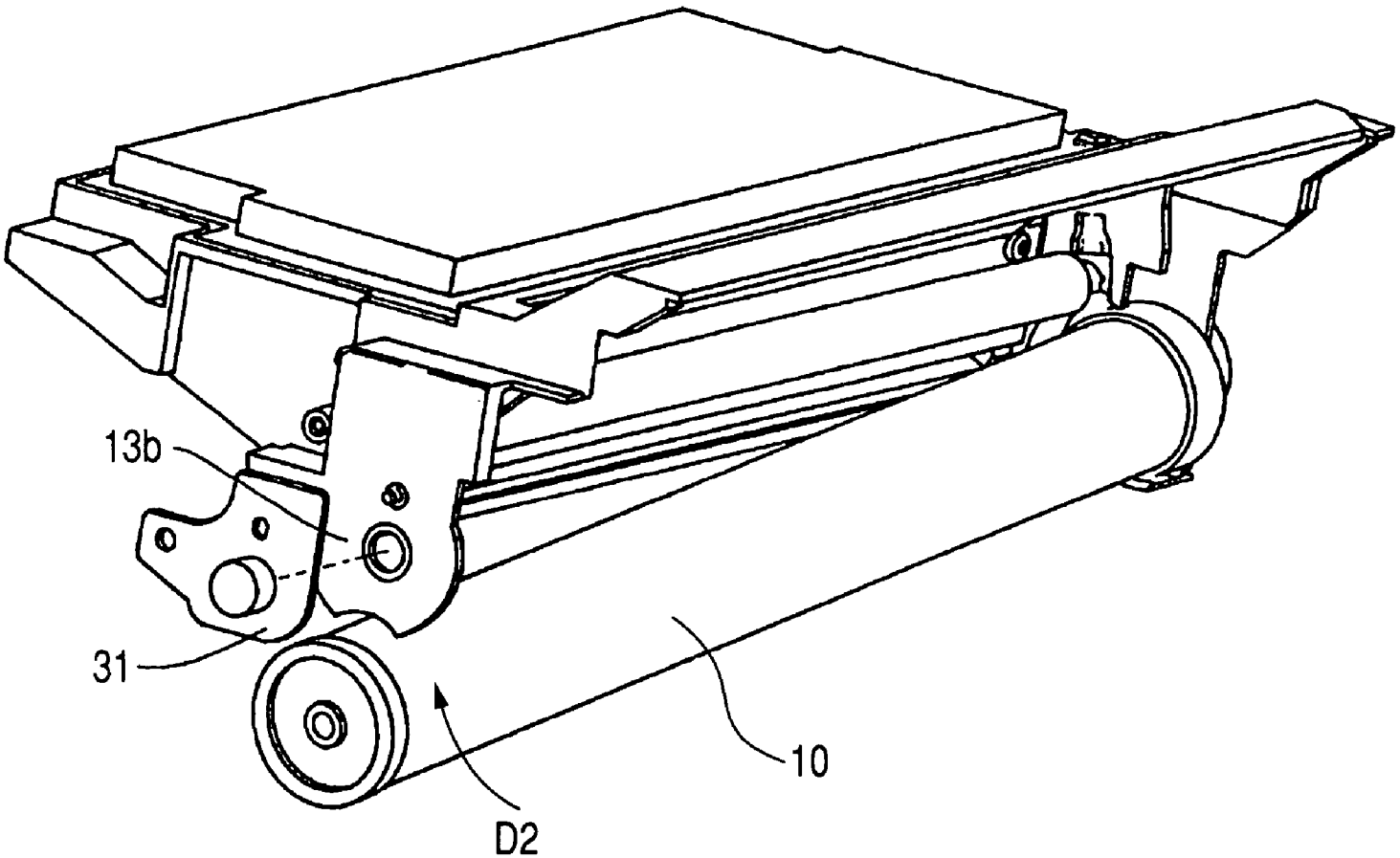
FIG. 38 is a perspective view illustrating how the photosensitive drum is mounted.

When the photosensitive drum 10 is detached, with solely the centering shaft 31 removed, the driving side flange 10*a* of the new photosensitive drum 10 is first inserted into the inner peripheral portion 30*a* of the drum bearing 30, and the non-driving side is shifted in the direction indicated by the arrow D2 in FIG. 38 to mount the centering shaft 31 to one longitudinal end of the drum frame 13.

(Method of Re-Assembling the Process Cartridge C)

(Frame Connecting Process)

Figure 39:
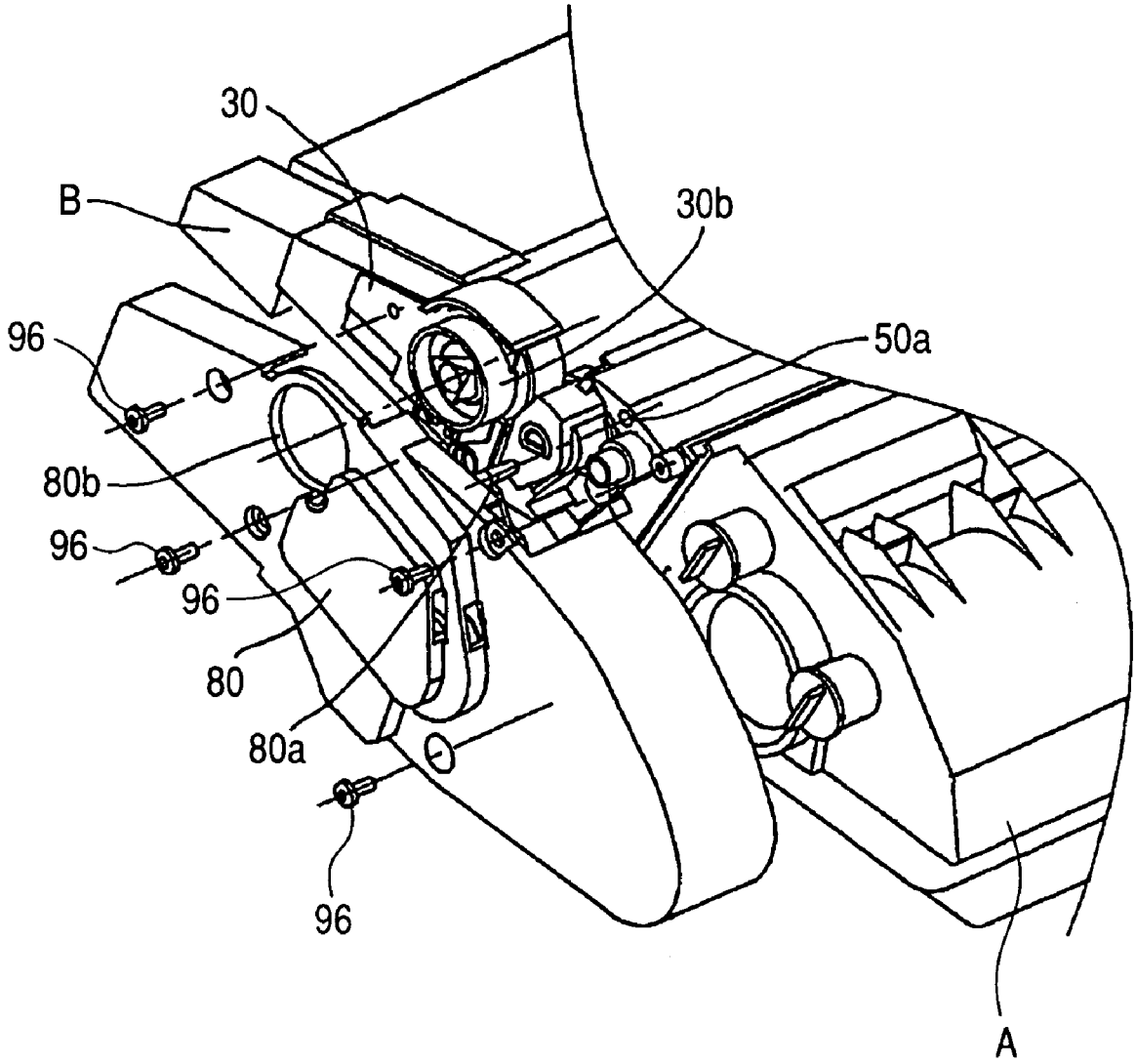
FIG. 39 is a perspective view illustrating a frame connecting process.

As shown in FIG. 39, the developing apparatus unit A and the photosensitive member unit B are installed so as to be opposed to each other. Then, the pin 80*a* for placing the first cover member 80 in position on the developing apparatus unit A is fit-engaged with the positioning hole 50*a* provided in the developing roller frame 50, and the hole 80*b* for placing the first cover member 80 in position on the photosensitive member unit B is fit-engaged with the outer diameter portion 30*b* of the drum bearing 30 of the photosensitive member unit B, whereby the positional relationship between the developing apparatus unit A and the photosensitive member unit B is determined. Thereafter, the two units are connected with the first cover member 80 by the screws 96.

Figure 40:
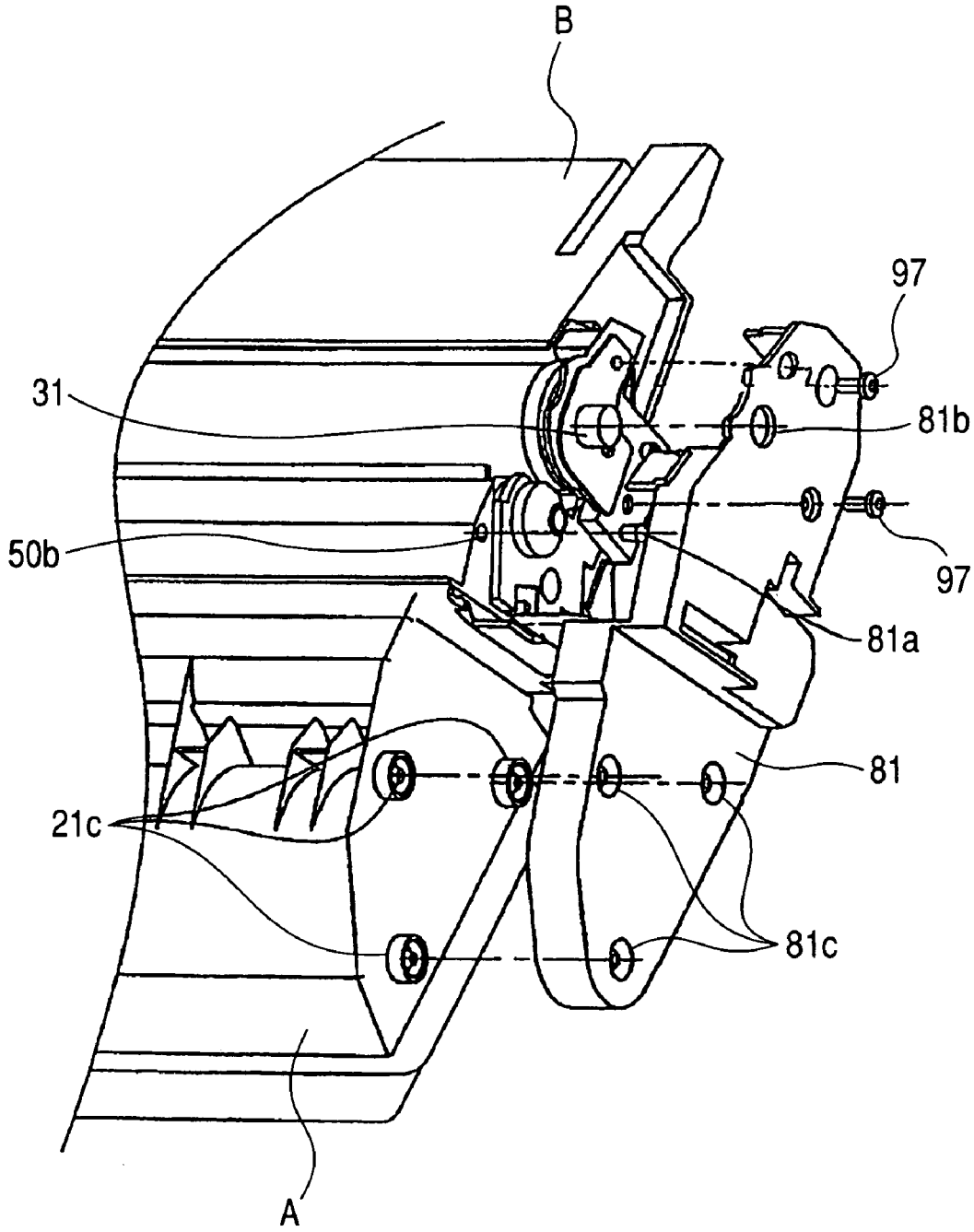
FIG. 40 is a perspective view illustrating a frame connecting process.

Similarly, as shown in FIG. 40, the pin 81*a* for placing the second cover member 81 in position on the developing apparatus unit A is fit-engaged with the positioning hole 50*b* provided in the developing roller frame 50, and the hole 81*b* for placing the second cover member 81 in position on the photosensitive member unit B is fit-engaged with the centering shaft 31 of the photosensitive drum 10 of the photosensitive member unit B, whereby the positions of the two units are determined. Thereafter, the developing apparatus unit A and the photosensitive member unit B are fixed to the second cover member 81 by resin bonding as follows.

Thereafter, the resin bonding portions of the developing apparatus unit A and the second cover member 81, separated in the above-described (First and Second Cover Member Detaching Process), are connected together by the following process.

(Resin Bonding Portion Connecting Process)

Figure 41A:
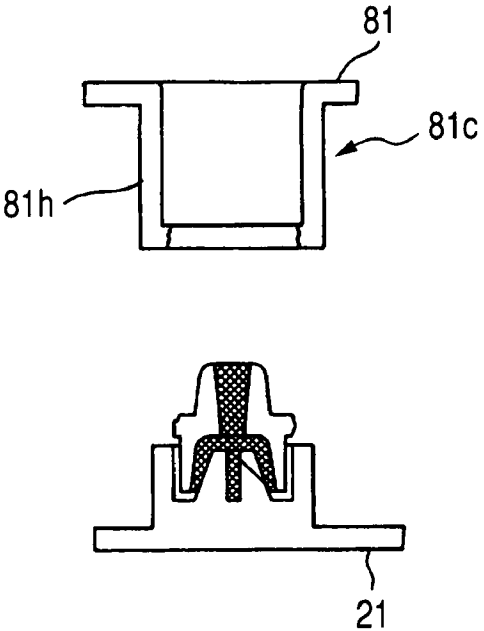
FIGS. 41A, 41B, and 41C are sectional views illustrating a resin-bonded portion connecting process.
Figure 41B:
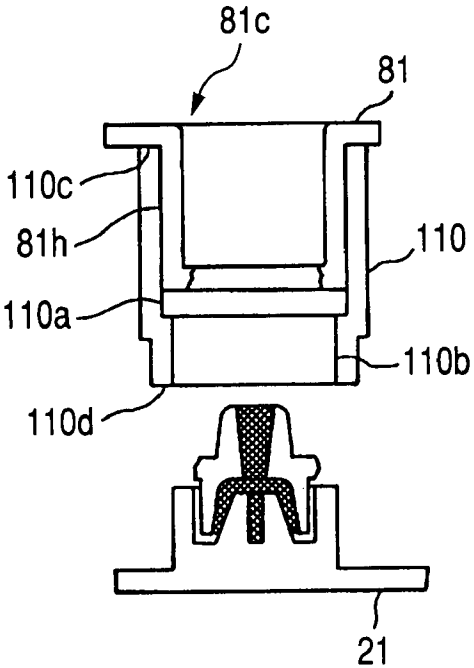
Figure 41C:
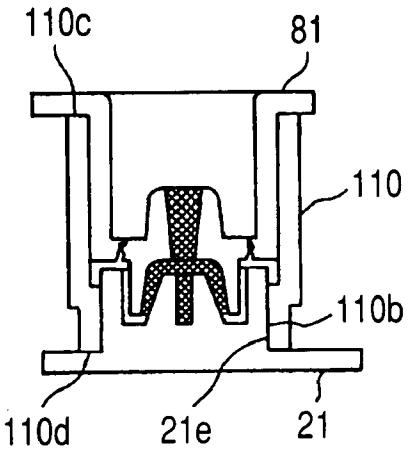

A method of connecting the separated resin bonding portions will be described with reference to FIGS. 41A, 41B, and 41C. FIG. 41A is a sectional view of the resin bonding portion separated by the above-described method.

The inner side of the cylindrical portion 81*h* of the resin bonding portion 81*c* is cut off, whereby the second cover member 81 is detached from the developer frame 21. In connecting the second cover member 81 and the developer frame 21, there is provided, as shown in FIG. 41B, a connecting member 110, and the cylindrical portion 81*h* of the resin bonding portion 81*c* of the second cover member 81 is press-fitted into a first press-fit portion 110*a* provided in the connecting member 110. Then, as shown in FIG. 41C, the cylindrical portion 21*e* of the resin bonding portion 21*c* of the developer frame 21 is press-fitted into a second press-fit portion 110*b* provided in the connecting member 110. Either of the second cover member 81 and the developer frame 21 may be press-fitted into the connecting member 110 first.

The first press-fit portion 110*a* of the connecting member 110 is of a cylindrical configuration and has a size such that a close fit is effected between itself and the cylindrical portion 81*h* of the second cover member 81. Similarly, the second press-fit portion 110*b* is of a cylindrical configuration and has a size such that a close fit is effected between itself and the cylindrical portion 21*e* of the developer frame 21.

Further, in this embodiment, the end surface 110*c* of the connecting member 110 is placed in position by abutting the second cover member 81. Similarly, the end surface 110*d* of the connecting member 110 is placed in position by abutting the developer frame 21. Thus, the positions of the second cover member 81 and the developer frame 21 are determined by the length of the connecting member 110. Thus, the length of the connecting member 110 is determined such that the second cover member 81 and the developer frame 21 are placed at positions equivalent to those prior to dismantling. By using such a connecting member, the positioning and connection can be effected more easily.

By thus connecting the second cover member 81 with the developer frame 21, the separated resin bonding portion can be connected easily without having to provide such processes as adhesion and post-treatment. There are no particular limitations regarding the material of the connecting member as long as it provides a fastening force strong enough to connect the second cover member 81 and the developer frame 21 according to the configuration and size of the press-fit portion.

Further, the replacement of the photosensitive drum 10 by a new one can be easily effected by the above-described remanufacturing method.

Also in the above construction, the connection of the resin bonding portion can be effected easily and reliably.

(Fixation Process)

Subsequently, the resin bonding portions of the photosensitive member unit B and the second cover member 81, separated by the above-described (First and Second Cover Member Detaching Process), are connected by the following process.

Figure 43B:
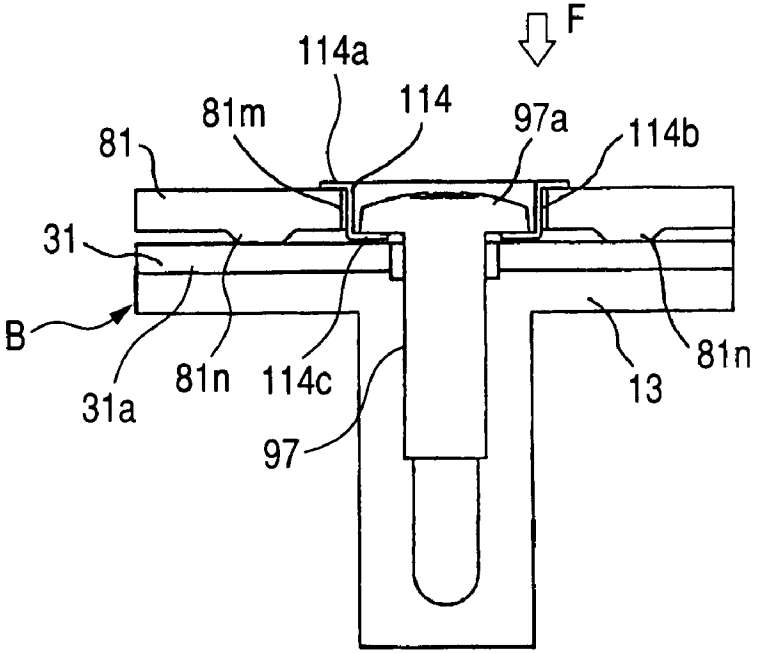
FIGS. 43A and 43B are sectional views of a screw mounting hole for mounting a centering shaft to the drum frame and portions in the vicinity thereof.
Figure 43A:
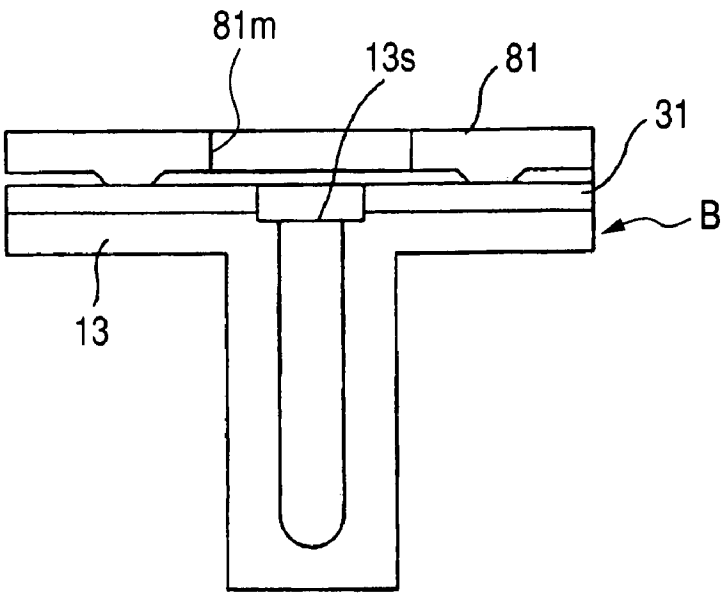

FIG. 43A is a sectional view of a screw mounting hole 13*s* (the prepared hole of a screw 97) for mounting to the drum frame 13 the centering shaft 31, which is the support member for rotatably supporting the photosensitive drum 10. FIG. 43B is a sectional view of the screw mounting hole 13*s* portion of the drum frame 13, to which the centering shaft 31 is mounted in a state in which the second cover member 81 and the photosensitive member unit B are connected together by using a fixation member 114 described below.

At this time, the fixation member 114 (see FIG. 44A) shown in FIG. 43B has a flange portion 114*a* whose diameter is larger than the diameter of a hole 81*m* of the second cover member 81, and an outer diameter smaller than the diameter of the hole 81*m*. Further, the fixation member 114 has a cylindrical portion 114*b* one end of which is connected with the inner diameter portion of the flange portion 114*a*, and a bottom portion 114*c* connected with the other end of the cylindrical portion 114*b* and equipped with a hole through which the screw 97 is to be passed. Further, the bottom portion 114*c* is equipped with a hole 114*d* through which the threaded portion of the screw 97 is passed.

When the screw 97 is screw mounted to the screw mounting hole 13*s*, a head 97*a* abuts the bottom portion 114*c*. Then, the screw 97 biases the fixation member 114 in the direction indicated by an arrow F.

Figure 42:
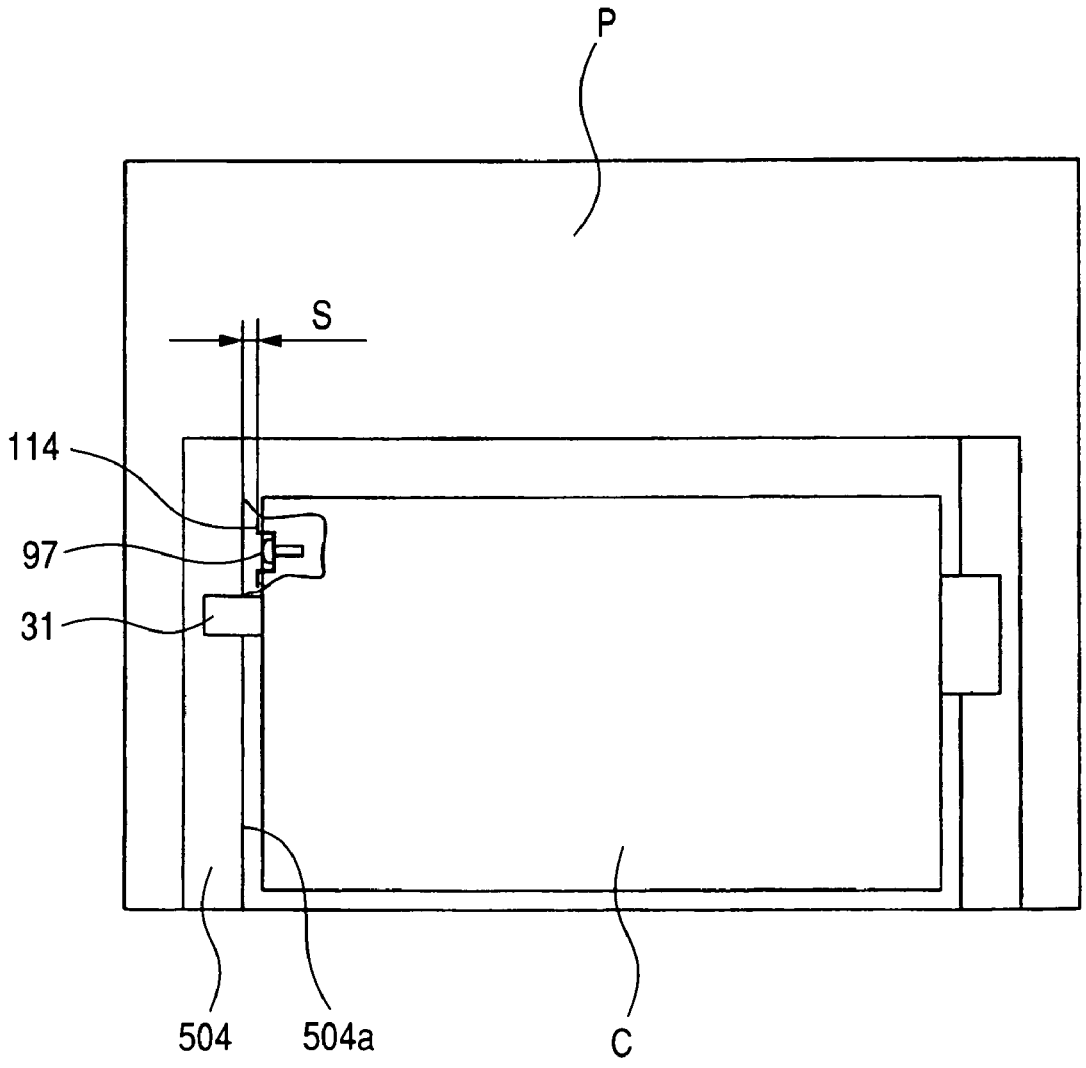
FIG. 42 is a schematic diagram illustrating how the process cartridge is attached to the apparatus main body.

The inner peripheral surface of the cylindrical portion 114*b* is larger than the outer diameter of the head 97*a* of the screw 97. Further, the height of the cylindrical portion 114*b* is such that the head 97*a* of the screw 97 does not protrude beyond the flange portion 114*a*. As a result, as shown in FIG. 42, when the process cartridge C is attached to the apparatus main body P, the clearance S between the inner surface 504*a* of the guide portion 504 of the main body P of the image forming apparatus and the longitudinal end portion of the process cartridge C is not reduced. That is, if the remanufactured cartridge C is attached to the main body P of the image forming apparatus, it is possible to secure the requisite clearance S.

Next, as shown in FIG. 43B, the fixation member 114 is fixed to the drum frame 13 by the screw 97. At this time, the flange portion 114*a* of the fixation member 114 abuts the second cover member 81, applying pressure on the second cover member 81 toward the drum frame 13 in the direction indicated by the arrow F. At this time, there is a gap in the direction indicated by the arrow F between the bottom portion 114*c* and the sheet metal portion 31*a* of the centering shaft 31.

Further, the centering shaft holding-down portion 81*n* of the second cover member 81 holds the sheet metal portion 31*a* of the centering shaft 31 between itself and the drum frame 13, whereby the centering shaft 31 is fixed to the drum frame 13. That is, by mounting the screw 97 to the screw mounting hole 13*s*, it is possible to mount the second cover member 81 and the centering shaft 31 simultaneously to the drum frame 13. As a result, even in the process cartridge remanufacturing method in which the resin bonding portions are once separated and connected again, it is possible to mount the photosensitive drum 10 firmly to the drum frame 13. Thus, also in the remanufactured process cartridge C, the photosensitive drum 10 can be rotated without involving unevenness in rotation or the like, making it possible to provide a high quality image.

Figure 44A:
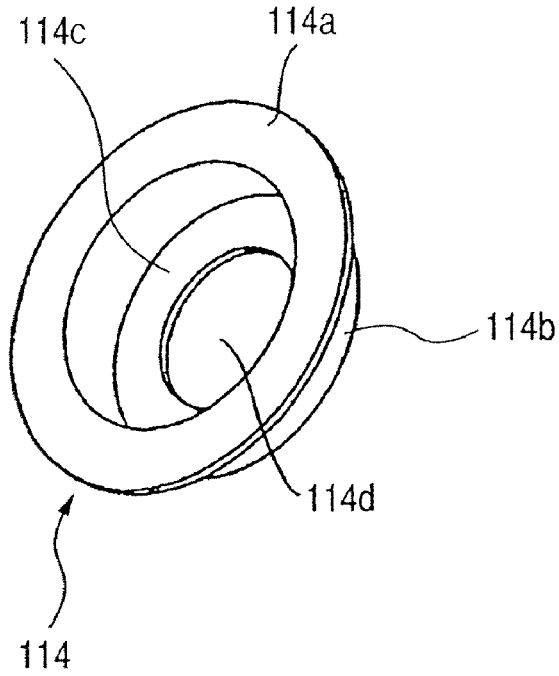
FIGS. 44A and 44B are perspective views of a fastening member.
Figure 44B:
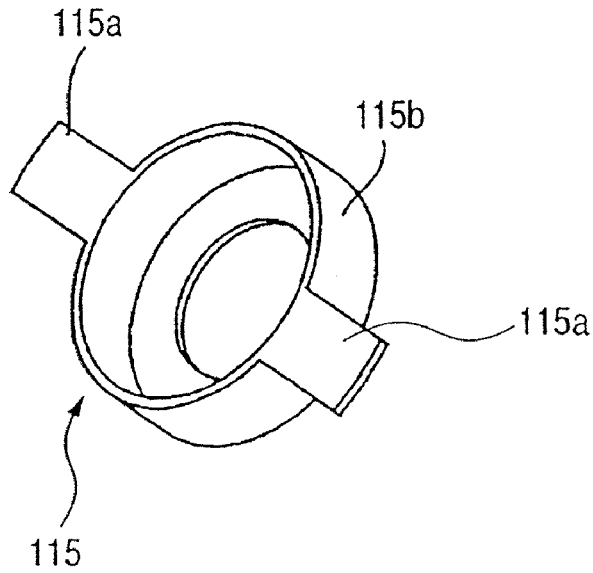

FIG. 44A is an outward perspective view of the fixation member 114. FIG. 44B shows a fixation member 115 which is a modification of the fixation member 114. The flange portion 115*a* of the latter is not circular but consists of substantially rectangular protrusions extending radially from the cylindrical portion 115*b*. The flange portions 115*a* are provided on the cylindrical portion 115*b* at two positions opposed to each other (that is, out of phase with each other by 180 degrees). Otherwise, the fixation member 115 is of the same construction as the fixation member 114.

As described above, the flange portions 115*a* apply pressure to press the second cover member 81 against the drum frame 13, whereby the second cover member 81, the centering shaft 31, and the drum frame 13 can be firmly fixed together.

The material of the fixation member 114, 115 used in the process cartridge remanufacturing method of this embodiment is metal or resin.

Further, the configurations of the fixation members 114 and 115 are not restricted to those shown in FIGS. 44A and 44B as long as they can mount the centering shaft 31 and the second cover member 81 to the drum frame 13.

As described above, according to this embodiment, in the method of remanufacturing the process cartridge which is detachably mountable to the main body of the electrophotographic image forming apparatus and which is secured in position to the cover members by pouring molten resin into the resin bonding portions provided in the drum frame, after separation of the drum frame and the cover members, re-connection of the drum frame and the cover members can be effected easily and firmly. Further, a process cartridge of which the developer has been consumed to a degree such that image formation is no longer possible and which is, consequently, of no commercial value, can be easily filled with developer.

The order of the processes of the process cartridge remanufacturing method of the present invention is not restricted to the above order; it is also possible to change the order as appropriate.

It should be noted that the present invention covers all of the following cases:

(1) A case in which, remanufacturing of a process cartridge is conducted by using only components that are detached from a single process cartridge.

(2) A case in which, when, in the above case (1), some components cannot be re-used since they have reached their end of life, or they have suffered damage, and the like, the remanufacturing of a cartridge is conducted by using new components or recycled components detached from other cartridges.

(3) In remanufacturing a process cartridge, components detached from a plurality of process cartridges are classified into groups each of which consists of components of the same kind. Then, the requisite components are picked up from among the components thus classified, and remanufacturing of a cartridge is conducted by recycling these components.

(4) A case in which, when, in the above case (3), some components cannot be re-used since they have reached their end of life, or they have suffered damage, and the like, the remanufacturing of a cartridge is conducted by using new components.

The components as mentioned above are articles constituting a certain portion of a cartridge. Here, minimum units allowing dismantling are also included.

As described above, according to the present invention, in the process cartridge remanufacturing method in which the drum frame and the developing frame are connected to the second cover member by pouring molten resin into the resin bonding portions, the drum frame, the developing frame, and the second cover member can be re-connected easily and firmly.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 2004-121927 filed Apr. 16, 2004, and Japanese Patent Application No. 2005-112646 filed Apr. 8, 2005 which are hereby incorporated by reference herein.

What is claimed is:

1. A process cartridge remanufacturing method for a process cartridge detachably mountable to an electrophotographic image forming apparatus, the process cartridge comprising a first electrophotographic photosensitive drum, a first drum frame supporting the electrophotographic photosensitive drum, a first developing roller adapted to develop an electrostatic latent image formed on the electrophotographic photosensitive drum by using a developer, a developing frame supporting the developing roller and having a developer containing portion containing the developer, a first cover member positioned and configured to secure the developing frame and the first drum frame in position at one longitudinal end of the drum frame, a second cover member positioned and configured to secure the developing frame and the first drum frame in position at the other longitudinal end of the first drum frame, and a first drum supporting member which serves to support the first electrophotographic photosensitive drum on the first drum frame and which is fixed by a screw to a screw hole provided on the first drum frame at the other longitudinal end of the drum frame, the first drum frame and the developing frame being connected to the second cover member by pouring molten resin into resin bonding portions provided in the first drum frame, the developing frame, and the second cover member, the process cartridge remanufacturing method comprising:

(a) a first cover member detaching step of detaching, at one longitudinal end of the process cartridge, the first cover member from the first drum frame and the developing frame;

(b) a second cover detaching step of detaching, at the other longitudinal end of the process cartridge, the second cover member from the first drum frame and the developing frame;

(c) a drum supporting member detaching step of detaching the first drum supporting member from the first drum frame;

(d) a frame separating step of separating the developing frame and the first drum frame;

(e) a developing roller detaching step of detaching the first developing roller from the developing frame;

(f) a developer re-filling step of filling the developer containing portion with the developer from a developer supply port provided on the developing frame exposed by detaching the first developing roller from the developing frame;

(g) a developing roller fixation step of mounting the first developing roller or a second developing roller to the developing frame filled with developer in said developer re-filling step or a different developer frame;

(h) a drum mounting step of mounting, at the one longitudinal end, the first electrophotographic photosensitive drum or a second electrophotographic photosensitive drum to the first drum frame or a second drum frame;

(I) a first frame connecting step of securing the drum frame undergoing the mounting performed in said drum mounting step and the developing frame undergoing the mounting performed in said developing roller fixation step in position at the one longitudinal end by the first cover member or a third cover member;

(j) a second frame connecting step of securing the drum frame undergoing the mounting performed in said drum mounting step and the developing frame undergoing the mounting performed in said developing roller fixation step in position at the other longitudinal end by the second cover member or a fourth cover member;

(k) a drum supporting member temporary mounting step of temporarily mounting the first drum supporting member or a second drum supporting member to support the electrophotographic photosensitive drum mounted in said drum mounting step at the other longitudinal end of the drum frame undergoing the mounting performed in said drum mounting step; and (l) a second cover member mounting step of mounting the drum supporting member temporarily mounted in said drum supporting member temporary mounting step and the second cover member or a fourth cover member to the drum frame undergoing the mounting performed in said drum mounting step by mounting a fixation member to a mounting hole provided in the second cover member by using a screw in the event the second cover member is mounted to the drum frame undergoing the mounting performed in said drum mounting step and by mounting the fixation member to a mounting hole provided in the fourth cover member in the event the fourth cover member is mounted to the drum frame undergoing the mounting performed in said drum mounting step.

2. A process cartridge remanufacturing method according to claim 1, wherein the fixation member has:

a flange portion that has a diameter larger than a diameter of the mounting hole of the second cover member and the fourth cover member and abuts the second cover member in the event the second cover member is mounted to the drum frame undergoing the mounting performed in said drum mounting step and abuts the fourth cover member in the event the fourth cover member is mounted to the drum frame undergoing the mounting performed in said drum mounting step;

a bottom portion which a head portion of the screw abuts; and a cylindrical portion that connects the flange portion and the bottom portion and has a diameter larger than a diameter of the head portion of the screw.

3. A process cartridge remanufacturing method according to claim 1, wherein the fixation member has:

a substantially rectangular flange portion that extends more greatly along a diameter direction of the hole than a diameter of the mounting hole of the second cover member and the fourth cover member and abuts the second cover member in the event the second cover member is mounted to the drum frame undergoing the mounting performed in said drum mounting step and abuts the fourth cover member in the event the fourth cover member is mounted to the drum frame undergoing the mounting performed in said drum mounting step;

a bottom portion which a head portion of the screw abuts; and a cylindrical portion that connects the flange portion and the bottom portion and which has a diameter larger than a diameter of the head portion of the screw.

4. A process cartridge remanufacturing method according to claim 2 or 3, wherein, when the fixation member is mounted to the drum frame undergoing the mounting performed in said drum mounting step, the flange portion presses the second cover member against the first drum supporting member in the event the second cover member is mounted to the drum frame undergoing the mounting performed in said drum mounting step and the first drum supporting member is temporarily mounted in said drum supporting member temporary mounting step, the flange portion presses the second cover member against the second drum supporting member in the event the second cover member is mounted to the drum frame undergoing the mounting performed in said drum mounting step and second first drum supporting member is temporarily mounted in said drum supporting member temporary mounting step, the flange portion presses the fourth cover member against the first drum supporting member in the event the fourth cover member is mounted to the drum frame undergoing the mounting performed in said drum mounting step and first drum supporting member is temporarily mounted in said drum supporting member temporary mounting step, and the flange portion presses the fourth cover member against the second drum supporting member in the event the fourth cover member is mounted to the drum frame undergoing the mounting performed in said drum mounting step and second first drum supporting member is temporarily mounted in said drum supporting member temporary mounting step.

5. A process cartridge remanufacturing method according to claim 2 or 3, wherein a height of the cylindrical portion is larger than a height of the head portion of the screw.

6. A process cartridge remanufacturing method according to claim 1, wherein a material of the fixation member is a metal.

7. A process cartridge remanufacturing method according to claim 1, wherein a material of the fixation member is a resin.

8. A process cartridge remanufacturing method according to claim 1, wherein, said drum mounting step mounts the second electrophotographic photosensitive drum, wherein the second electrophotographic photosensitive drum is a new electrophotographic photosensitive drum.

9. A process cartridge remanufacturing method according to claim 1, wherein said second frame connecting step secures the drum frame undergoing the mounting performed in said drum mounting step and the developing frame undergoing the mounting performed in said developing roller fixation step in position at the other longitudinal end by the second cover member detached in said second cover member detaching step.

* * * * *

UNITED STATES PATENT AND TRADEMARK OFFICE

CERTIFICATE OF CORRECTION

PATENT NO. : 7,266,326 B2 
APPLICATION NO. : 11/105553
DATED : September 4, 2007
INVENTOR(S) : Toshiyuki Karakama et al.

It is certified that error appears in the above-identified patent and that said Letters Patent is hereby corrected as shown below:

ON THE TITLE PAGE
At Item (57), Abstract, line 14, “photosensitive;” should read --photosensitive drum--.

COLUMN 22
Line 48, “(I)” should read --(i)--.

COLUMN 23
Line 35, “move greatly” should read --further--.

Signed and Sealed this

Tenth Day of February, 2009

JOHN DOLL
*Acting Director of the United States Patent and Trademark Office*